US010433608B2

(12) United States Patent
Livingston

(10) Patent No.: US 10,433,608 B2
(45) Date of Patent: Oct. 8, 2019

(54) MOUNTING SYSTEM FOR EYEGLASSES AND HATS

(71) Applicant: Monte Livingston, San Clemente, CA (US)

(72) Inventor: Monte Livingston, San Clemente, CA (US)

( * ) Notice: Subject to any disclaimer, the term of this patent is extended or adjusted under 35 U.S.C. 154(b) by 10 days.

(21) Appl. No.: 15/785,057

(22) Filed: Oct. 16, 2017

(65) Prior Publication Data

US 2019/0110543 A1 Apr. 18, 2019

(51) Int. Cl.
*A42B 1/24* (2006.01)
*A45F 5/02* (2006.01)

(52) U.S. Cl.
CPC ..... *A42B 1/247* (2013.01); *A45F 5/02* (2013.01); *A45F 2200/0541* (2013.01)

(58) Field of Classification Search
CPC ..... A45F 5/02; A45F 2200/0541; A42B 1/247
See application file for complete search history.

(56) References Cited

U.S. PATENT DOCUMENTS 1,434,607 A * 11/1922 Gilson ..... A42B 1/041 132/274
2,013,636 A 9/1935 Shoskey et al.
3,173,147 A * 3/1965 Gross ..... A42B 1/16 2/452
3,397,026 A * 8/1968 Spina ..... G02C 3/003 2/13
4,179,753 A * 12/1979 Aronberg ..... A42B 1/247 2/10
4,184,343 A 1/1980 Green
4,549,793 A * 10/1985 Yoon ..... A42B 1/247 351/123
4,606,453 A * 8/1986 Burns ..... A45C 11/04 2/13
4,930,885 A * 6/1990 Laschober ..... G02C 3/003 2/452
5,347,655 A * 9/1994 Garrett ..... A42B 1/247 2/10
5,926,854 A * 7/1999 Grilliot ..... A61F 9/025 2/422
D435,265 S * 12/2000 Landis ..... D16/339
6,185,748 B1 2/2001 DeChambeau
6,282,721 B1 9/2001 Travalgia
6,428,167 B1 * 8/2002 Leonardi ..... A61F 9/027 132/273
6,553,570 B1 4/2003 Flynn
(Continued)

*Primary Examiner* — Robert Sandy
*Assistant Examiner* — David M Upchurch
(74) *Attorney, Agent, or Firm* — Stetina Brunda Garred and Brucker

(57) ABSTRACT

A pair of mounting pins are each inserted through the bill of a baseball hat. Each pin is releasably engaged with a base to connect to the bill at various locations. Each of the bases is connected to a flexible tether that is adjustable in length and preferably forms an elastic loop. Each temple arm of an eyeglass is inserted through a different loop, with the slide lock tightened to securely connect the loop to the temple arm of the eyeglasses and connects each temple arm the bill of the hat, at a location below the bill. The elastic loops encircling the temple arms to maintain the eyeglasses at a desired location on the cap and accommodate differing eyeglasses.

14 Claims, 15 Drawing Sheets

(56) References Cited

U.S. PATENT DOCUMENTS

| | | | | |
|---|---|---|---|---|
| 6,560,903 | B1 * | 5/2003 | Darley | A43B 3/0031 24/712.2 |
| 6,647,554 | B1 | 11/2003 | Yan | |
| 6,671,885 | B2 | 1/2004 | Viggiano | |
| 7,013,491 | B2 | 3/2006 | Ferrara | |
| 7,207,673 | B1 | 4/2007 | Ho | |
| D547,531 | S | 7/2007 | Wilson et al. | |
| 7,240,370 | B2 * | 7/2007 | Lerner | A42B 1/247 2/10 |
| 7,448,092 | B2 | 11/2008 | Wu | |
| D613,040 | S | 4/2010 | Pearson | |
| 7,703,153 | B2 | 4/2010 | de Taboada | |
| D617,537 | S | 6/2010 | Pearson | |
| 8,210,676 | B1 | 7/2012 | Hunt | |
| 8,245,320 | B2 | 8/2012 | Provost et al. | |
| D678,663 | S | 3/2013 | Gill | |
| D691,349 | S | 10/2013 | Pearson | |
| 8,573,773 | B1 | 11/2013 | Acosta | |
| 8,740,379 | B2 | 6/2014 | Berger | |
| D718,021 | S | 11/2014 | Werezberger | |
| D752,342 | S | 3/2016 | Woods | |
| 9,285,607 | B2 | 3/2016 | Tahsler et al. | |
| D759,947 | S | 6/2016 | Yurevich | |
| D761,001 | S | 7/2016 | Kouns et al. | |
| 9,622,528 | B1 | 4/2017 | Pitts et al. | |
| 2007/0192933 | A1 | 8/2007 | Kam | |
| 2008/0054033 | A1 * | 3/2008 | Synness | A42B 1/24 224/181 |
| 2010/0014046 | A1 | 1/2010 | Millios | |
| 2010/0212067 | A1 | 8/2010 | Thomas | |
| 2010/0231851 | A1 | 9/2010 | Anhalt | |
| 2011/0247120 | A1 * | 10/2011 | Knoedler | A42B 1/247 2/10 |
| 2012/0297522 | A1 | 11/2012 | Treger et al. | |
| 2014/0013480 | A1 | 1/2014 | Treger et al. | |
| 2015/0013114 | A1 * | 1/2015 | Grame | A42B 1/247 24/3.8 |
| 2015/0253584 | A1 | 9/2015 | Pond | |

* cited by examiner

MOUNTING SYSTEM FOR EYEGLASSES AND HATS

BACKGROUND

Persons wearing eyeglasses often experience visual problems caused by glare from eyepieces impinging on the eye, or reflections on the eyepieces causing visual blockage or distortion to the wearer of the eyeglasses. As used herein, the term eyeglasses include sunglasses, safety eyeglasses, spectacles and other eyewear held by a frame rim supported on a user's nose and having temple arms extending along a person's head with temple tips usually extending over and/or around a user's ears so the nose and ears support the eyeglasses on the user's head.

To reduce glare and reflections users commonly wear hats to shade the user's eyes and eyeglasses. As used herein, the term "hat" includes visors, baseball caps, safety helmets, hats and other head ware that encloses part of a user's head and have part of the headwear or hat extending outward from a location above the user's eyes in order to shade the user's eyes and eyeglasses from sunlight or artificial lights.

There is often a need to keep the user's eyeglasses with the user's hat. For example, lifeguards wearing a hat and sunglasses may need to quickly discard both items when rushing into the water for a rescue, subjecting both items to risk of damage or loss. Likewise, a worker with a safety helmet may want to keep safety eyeglasses associated with a helmet assigned to the worker, or perhaps may want to keep prescription safety eyeglasses associated with a personal helmet owned by the worker. There is thus a need for an improved way to keep eyeglasses associated with a user's hat.

Moreover, when eyeglasses are removed from the person wearing them, they are subject to risk of loss because people forget where they set the eyeglasses down. Also, eyeglasses are small and often difficult to see once misplaced, so eyeglasses are often overlooked and lost or take a lot of time to find. There is thus a need for an improved way to help locate misplaced eyeglasses as well as a way to help avoid loss of or misplacement of eyeglasses.

Some people use eyeglass retainers that have a strap looping around the back of the user's head and fasten to each temple tip of the eyeglasses. But such retainers do not necessarily help locate eyeglasses that are misplaced. Moreover, when fastened to the eyeglasses the retainer and eyeglasses form a loop which can be tightened around a person's head or neck, and many people object to placing a loop around their neck. There is thus a need for an improved way to help locate misplaced eyeglasses while retaining them on or adjacent to a user's head.

The tips of the temple arms curve around part of the user's ear or around a user's head, but provide a poor connection to the user's head so that the eyeglasses may become dislodged by active movement of the user's head or by contact with others during sporting activities. Eyeglass retainers are typically tightened to conform to the user's head to try and help avoid separating the eyeglasses from the user's head, but separation still occurs and the eyeglass lenses may still be damaged if the eyeglasses land on the lens. There is thus needed an improved way to retain eyeglasses on a user's head and to reduce damage to the eyeglass lenses if the eyeglasses are removed and fall to the ground, and to make it easier to locate eyeglasses removed from the user's head.

BRIEF SUMMARY

In a preferred form, a pair of mounting pins are provided with the pins configured so they can each be inserted through the bill of a baseball cap. Each of the pins may include a lower pin lock or base which releasably connects to a pin, preferably using mating threads on the pin and base. The pins and bases allow connections to the bill of the hat at various locations. Each of the bases is connected to a flexible tether, preferably an adjustable length loop and more preferably to an elastic loop. The elastic loop is preferably adjustable via a slide lock to allow each of the temple arms of eyeglasses to be inserted through a different loop. Once inserted, the slide lock is tightened and securely connects the loop to the temple arm of the eyeglasses and thus connects each temple arm to the cap, below the bill of the cap, thus tethering the eyeglass' arm to the bill of the cap. The use of elastic loops which interact with the temple arms of the eyeglasses to maintain the eyeglasses in a desired location upon the cap and the ability to accommodate differing sized/type of sunglasses is believed to provide many advantages.

As the mounting pins are manually insertable in different locations on the bill of the cap, the location of the eyeglasses relative to the cap can be adjusted. As the flexible tether allows movement of the head relative to the hat, and as the tethers are adjustable in size to accommodate different sized temple arms, the present invention accommodates a wide variety of differing sizes and types of eyeglasses, including wide and narrow temple arms, and eyeglasses of differing width and shape. By connecting the eyeglasses to the hat, the removal of the hat removes the eyeglasses while maintaining the eyeglasses with the hat. Because the hat is much more visible than the eyeglasses, maintaining the eyeglasses with the hat helps locate the eyeglasses and helps prevent misplacing or losing the eyeglasses. As the hat is larger and more visible than the eyeglasses, it is also less likely that someone will step on the hat and break the eyeglasses connected to the hat if they are on the ground. By connecting the eyeglasses to the hat, the hat also provides some cushioning and protection to the eyepieces to reduce scratching of the lenses—but that may vary with how the hat hits the ground and whether the hat is hard or soft or flexible. Also, by connecting the eyeglasses to the hat, a tight-fitting hat may help retain the eyeglasses on the user's head, especially during active sports, while also reducing the adverse glare from the sun or artificial lights. By flexibly connecting the eyeglasses to the hat, the position of the eyeglasses may optionally be adjusted relative to the user's head during use and relative to the hat during use. By connecting the eyeglasses to a baseball hat, with the lenses held close to the underside of the bill of the hat, many or all of the advantages are provided.

In more detail, there is provided an apparatus for connecting temple arms of a pair of eyeglasses to the bill of a hat where the bill has a thickness T. The apparatus includes first and second releasable fasteners and first and second flexible tethers. Each tether advantageously has a first end connected to a different one of the releasable fasteners and also advantageously has a second end with an opening therein. A slide lock is connected to the tether so the lock is movable along a length of the tether to vary the size of the opening. Each tether is preferably laterally flexible about an axis orthogonal to a length of the tether. Each tether preferably has a length of about 0.5 to about 4 inches, and more preferably about 0.5 to about 3 inches, and even more preferably about 1 to about 2 inches.

In further variations, each tether comprises a flexible member that is longer than it is wide with the longer part of the flexible member folded back on itself to form a loop about the opening at the second end. Opposing ends of the longer part of the flexible member are preferably connected by an end piece to form the first end of the tether. Advantageously, each tether is made of a stretchable material that can stretch at least around the opening at the second end. Further, each tether is preferably of elastic material that can resiliently stretch axially about 20% or more.

There is also provided an apparatus for connecting temple arms of a pair of eyeglasses to a bill of a hat where the bill has a thickness T. The apparatus may include first and second releasable fasteners each having one of a pointed shaft or a clip. The apparatus advantageously includes first and second flexible tethers, each having a first end connected to a different one of the releasable fasteners and having a second end with an opening therein, and a slide lock movable along a length of the tether to vary the size of the opening. Each tether is laterally flexible about an axis orthogonal to a length of the tether and each tether advantageously has a length of about 0.5 to about 4 inches, more preferably about 0.5 to 3 inches and even more preferably about 1 inch to about 2 inches.

In further variations of this apparatus, each tether includes a flexible strip that is longer than it is wide with the longer part of the strip of folded back on itself to form a loop about the opening at the second end. The opposing ends of the strip are connected by an end piece to form the first end of the tether. Each tether is made of a material that can resiliently stretch at least around the opening at the second end.

In further variations of this apparatus, the first and second releasable fasteners each comprise a threaded male fastener having a pointed distal end opposite an enlarged head. The first and second fasteners each further having a mating female part with a recess configured to engage the male fastener. The male fastener passes through the first end of the tether, preferably either by passing through a hole preformed in the tether, preferably preformed in an end piece of the tether, or by passing through the material of the tether at a location selected by the user. Each male fastener preferably has a length of greater than T and less than about 3T. Advantageously, the first releasable fastener passes through a first side of the bill of the hat and the second fastener passes through a second, opposing side of that bill of the hat at a location opposite the first releasable fastener. The first temple arm advantageously passes through the opening in the first tether and the second temple arm passes through the opening in the second tether to connect the tether to the glasses and hat.

In still further variations, the first and second releasable fasteners each comprise a male fastener having a shaft with a pointed distal end opposite an enlarged head. The first and second fasteners may each further have a clutch releasably engaging the shaft of the male fastener. The fasteners may further include a male projection having an end passing through a hole in the end fitting in a snap-fit connection. Advantageously, the first releasable fastener passes through a first side of the bill of the hat and the second fastener passes through a second, opposing side of that bill of the hat at a location opposite the first releasable fastener. The first temple arm advantageously passes through the opening in the first tether and the second temple arm passes through the opening in the second tether to connect the tether to the glasses and hat.

In further variations, the first and second releasable fasteners may each comprise a clip having first and second opposing side, each side having a length of about 0.5 to 1.5 inches and having a distal end spaced apart a distance less than a thickness T of the bill of the hat. Each side advantageously has a proximal end joined to a base and spaced apart a first distance of about T at the base. The second side is preferably connected to the first end of the respective tether, and more preferably is connected by a threaded fastener passing through at least part of a hole in an end piece of the tether. Advantageously, a plurality of holes is formed in the second side, with each hole threaded to receive a threaded fastener passing through a hole in the second end of the tether to connect the tether to the clip. Advantageously, the first clip is connected to a first side of the bill of the hat and the second clip is connected to a second, opposing side of that bill of the hat at a location opposite the first releasable fastener. The first temple arm passes advantageously passes through the opening in the first tether and the second temple arm passes through the opening in the second tether to connect the tether to the glasses and hat.

In each of the above apparatus and variations, the hat preferably comprises a baseball hat, or a hat having a hard shell configured to encase a portion of a person's head during use.

There is also provided a kit for connecting temple arms of a pair of eyeglasses to a bill of a hat where the bill has a thickness T. the kit preferably includes any of the above apparatus or variations of that apparatus. The kit may also include first and second releasable fasteners comprising one of a fastener or clip. The kit also advantageously includes first and second tethers, each having a first end connected to a different one of the releasable fasteners and having a second end with an opening therein, and a slide lock movable along a length of the tether to vary the size of the opening. Each tether may be laterally flexible about an axis orthogonal to a length of the tether, each tether having a length of about 0.5 to about 3 inches, each tether being of a material that can resiliently stretch about 20% or more at least around the opening at the second end.

In further variations, each tether in the kit includes an elongated flexible and elastic member with a rectangular cross-section is folded back on itself to form a loop about the opening at the second end, and with opposing ends of the member connected to the first end of the tether. In such cases, the kit has the sliding lock configured to easily slide along a length of the tether when the tether is stretched but not when the tether is not stretched.

In still further variations, the kit has first and second releasable fasteners each comprising a male fastener having a pointed head opposite an enlarged end and a length greater than T and less than about 3T. The first and second fasteners each further have a female part configured to releasably engage the male fastener, with the first end of the tether configured to allow passage of the male fastener.

In further variations of the kit, the first and second releasable fasteners each comprise a male fastener having a shaft with a pointed distal end opposite an enlarged head. The first and second fasteners each have a clutch releasably engaging the shaft of the male fastener. The clutch further includes a male projection having an end passing through a hole in the end fitting in a snap-fit connection. In this variation, the clutch has both a female receiving portion to releasably engage the shaft of the male fastener, and also has a male projection to releasably engage a hole in the tether.

In additional variations, the first and second releasable fasteners of the kit may each comprise a clip having first and second opposing side. Each side may have a length of about 0.5 to 1.5 inches and a distal end spaced apart a distance less than a thickness T of the bill of the hat. Each side has a proximal end joined to a base and spaced apart a first distance of about T at the base. The second side is connected to the first end of the respective tether. Advantageously, the connection is achieved by providing a plurality of holes in the second side, with each hole threaded to receive a threaded fastener passing through a hole in the second end of the tether to connect the tether to the clip. Advantageously the plurality of holes comprises only a few holes, from two to four, spaced along a length of the second side.

BRIEF DESCRIPTION OF THE DRAWINGS

These and other features and advantages of the invention will become more apparent in light of the following discussion and drawings, in which like numbers refer to like parts throughout, and in which.

DETAILED DESCRIPTION

Figure 1:
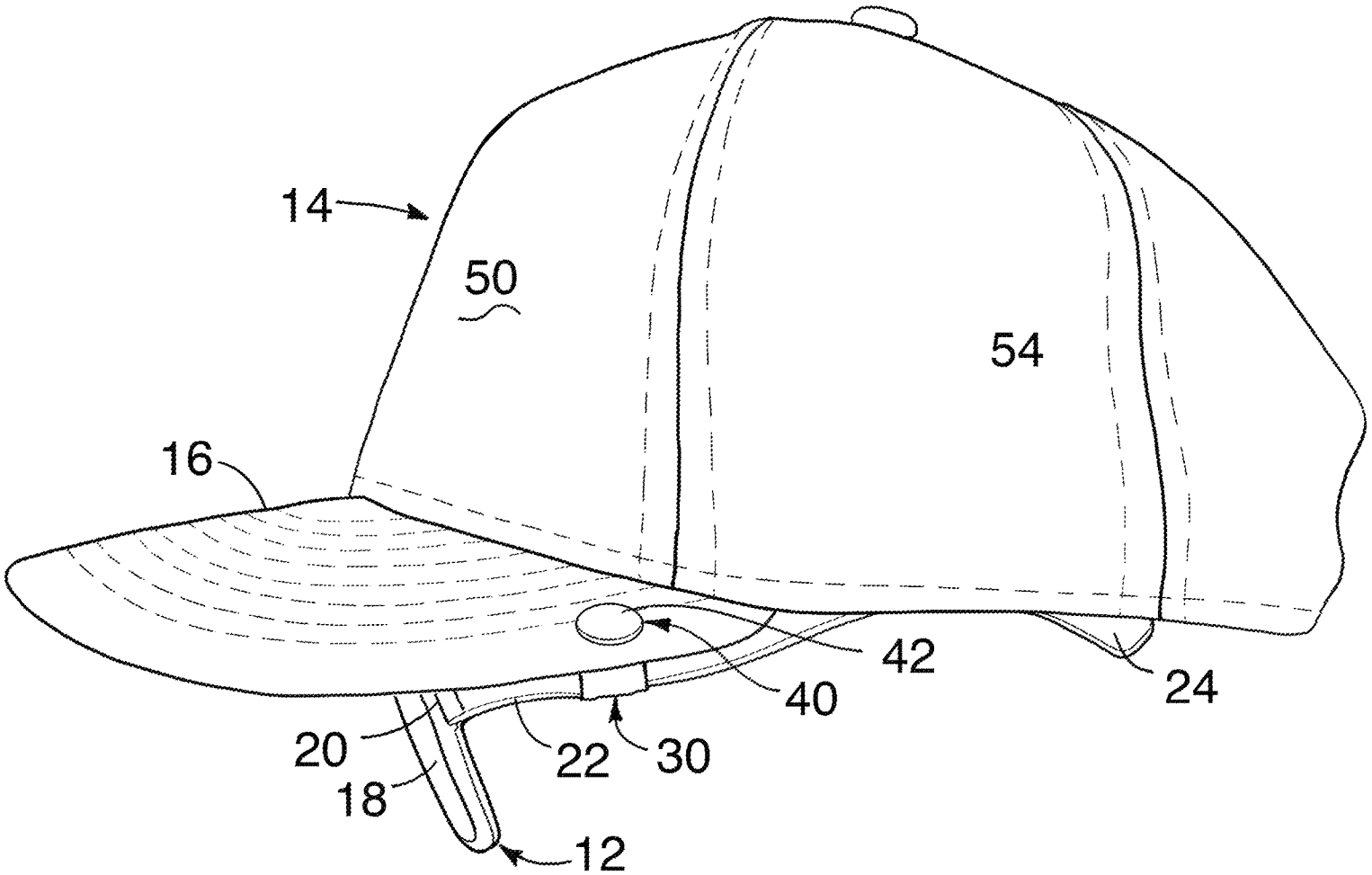
FIG. 1 is a side view of a hat with eyeglasses connected to the hat.

The following part numbers and part names are generally used herein: 10—system and apparatus; 12—eyeglasses; 14—hat; 16—bill; 17—longitudinal axis; 18—lens; 20—frame rim; 22—temple arm; 24—temple tip; 30—flexible tether; 31—elongated member; 32—end piece; 34—hole in end piece; 36—opening in loop; 38—slide lock; 39—longitudinal axis of tether 30; 40—fastener; 42—head $1^{st}$ part; 44—shaft $1^{st}$ part; 46—head $2^{nd}$ part; 48—tube $2^{nd}$ part; 50—crown of hat; 52—sweatband; 54—middle panels; 60—clutch; 62—enlarged head; 64—bore; 66—projection; 68—groove; 70—end of projection 66; 72—set screw; 80—clip; 82*a, b*—sides of clip; 84—base of clip; 86—holes in clip; 88—fastener; 90—offset area; and 92—surface texture.

Referring to FIGS. 1-6, a system and apparatus 10 are shown for releasably connecting eyeglasses 12 to an outwardly extending flange or bill 16 of a hat 14 having longitudinal axis 17, and preferably to the bill of a baseball cap. The bill 16 is sometimes called the brim or visor. The following description refers to the preferred embodiment of a baseball cap 14 but the description is applicable to other hats with outward extending flanges or bills. The eyeglasses 12 typically have one or two lenses 18 in a frame rim 20. The lense(s) 18 may be glass, plastic or other polymers and may or may not have optical power. Two temple arms 22 are connected to the eyeglasses, one arm on each side of the frame rim 20. The connection of each arm 22 to the frame rim 20 is usually at a hinged joint so the arms 22 can rotate toward each other into a folded, collapsed configuration. The arms 22 are shown in an open, expanded configuration for use, in a configuration with temple arms 22 generally parallel and generally perpendicular to the frame rim 20. Each temple arm 22 has a tip 24 at its free, distal end. The temple tip 24 is typically curved downward around the user's ear or it is curved inward around the back of the user's head, or both.

Each temple arm 22 passes through a flexible tether 30, the ends of which are connected to the underside of the bill 16 of the baseball hat 14. The flexible tether 30 preferably comprises an elongated strip 31 of elastic material with both ends joined together by an end piece 32 having a hole 34 through the end piece. The end piece 32 is preferably formed by a plate or other strip of material enclosing enough of two opposing sides of the looped strip 31 to hold them together during use. The flexible tether 30 is preferably made from a single elongated strip of material or single elongated member 31 that is folded back on itself to form an opening 36 through which the temple arm 22 can pass during use, and with the two ends of the elongated member or elongated strip clamped together to form a loop defining opening 36. A clamp comprising metal end piece 34 at the ends of member 31 is believed suitable. The tether 30 is preferably formed from a rectangular strip of flat, elastic material 31, but elongated members having cross-sections other than rectangular can be used, including circular cross-sections and various tubular cross-section including sections of cylindrical tubes.

Figure 8:
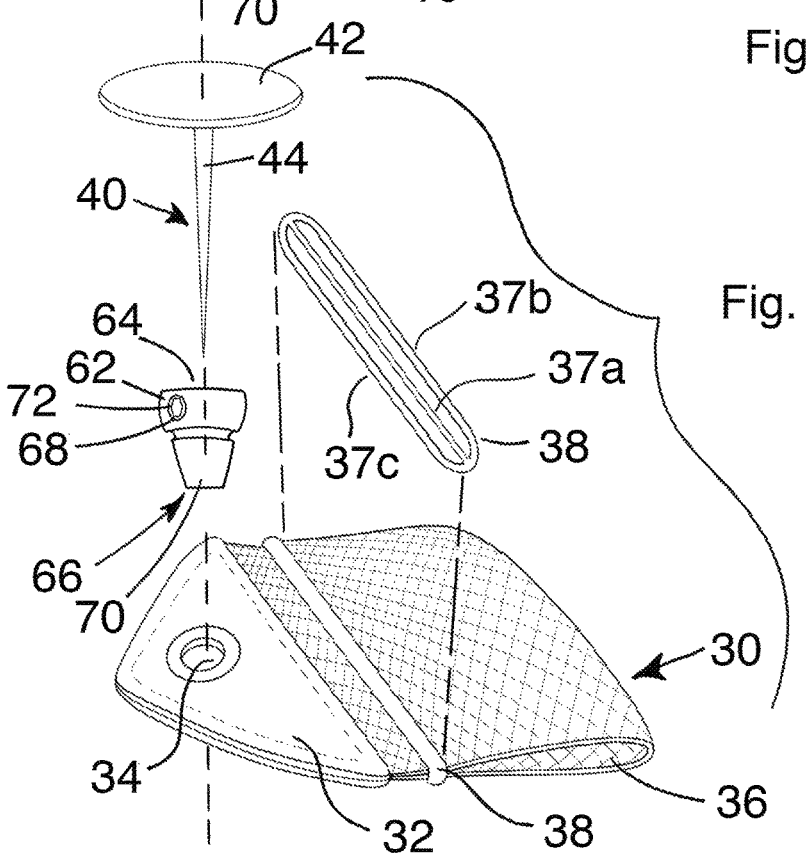
FIG. 8 is an exploded view of the fastener, clutch and tether of FIG. 7.
Figure 9:
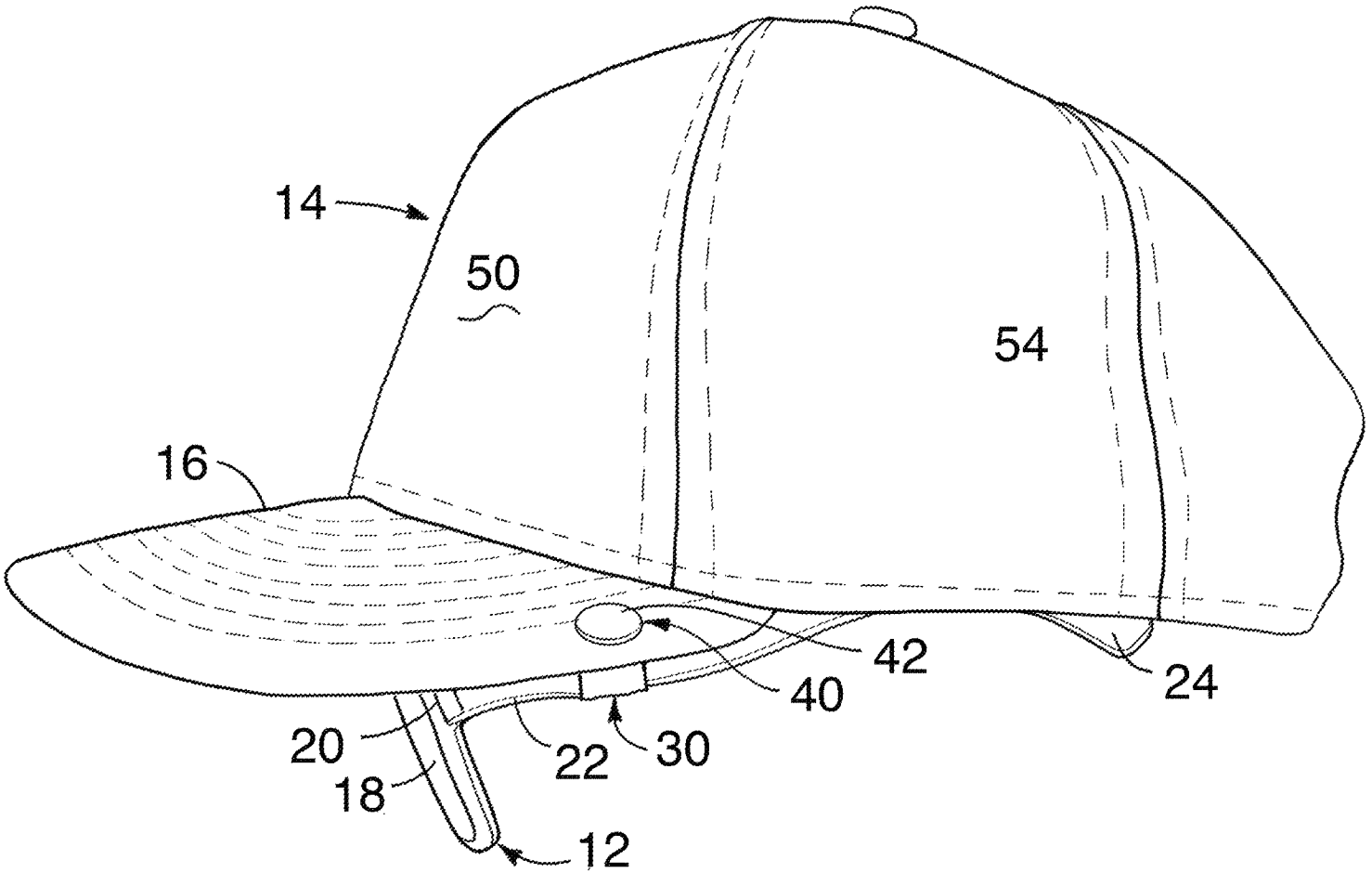
FIG. 9 is a side view of the hat of FIG. 7 with eyeglasses connected to the tether.
Figure 10:
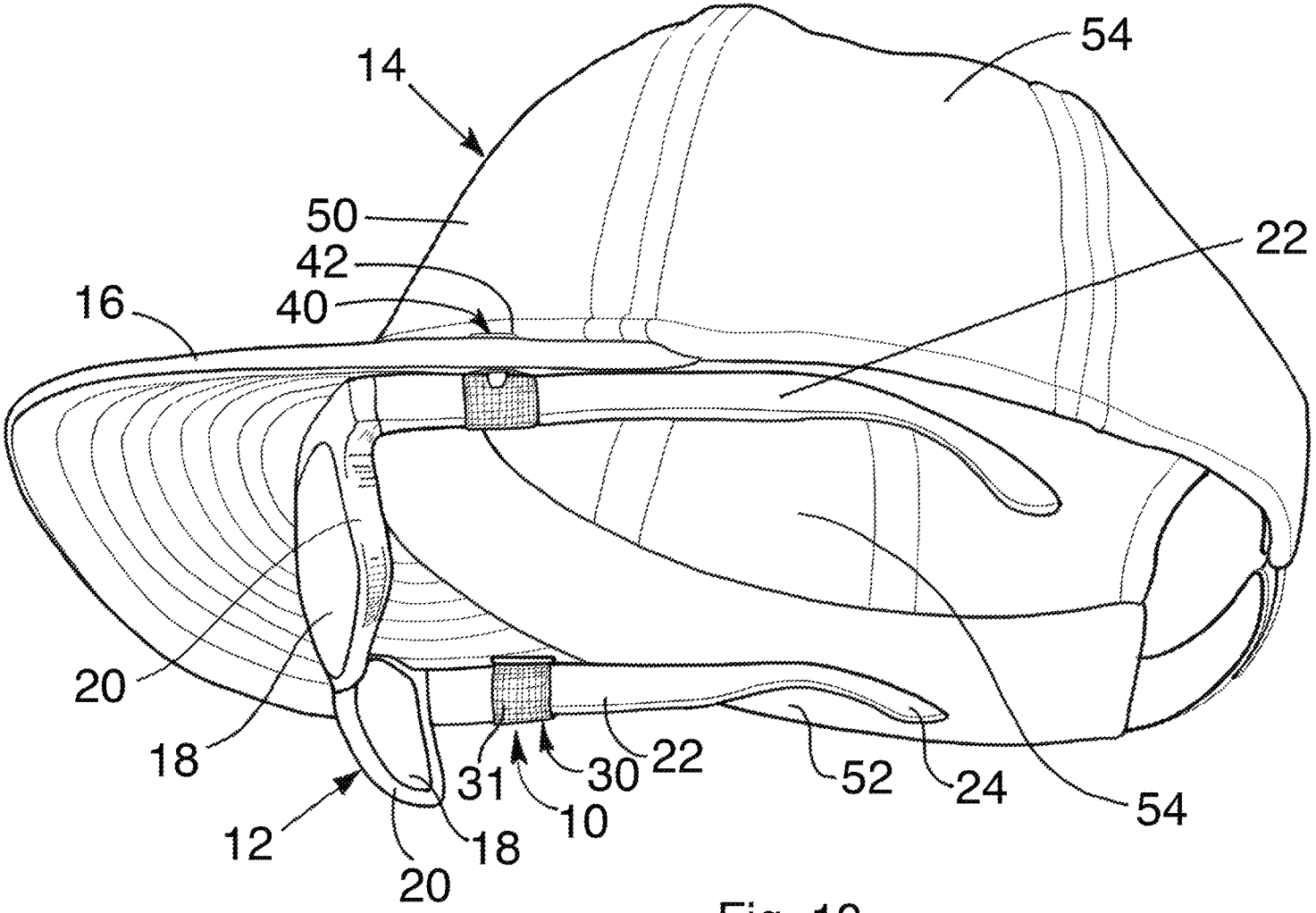
FIG. 10 is a lower perspective view of the hat of FIG. 9.
Figure 11:
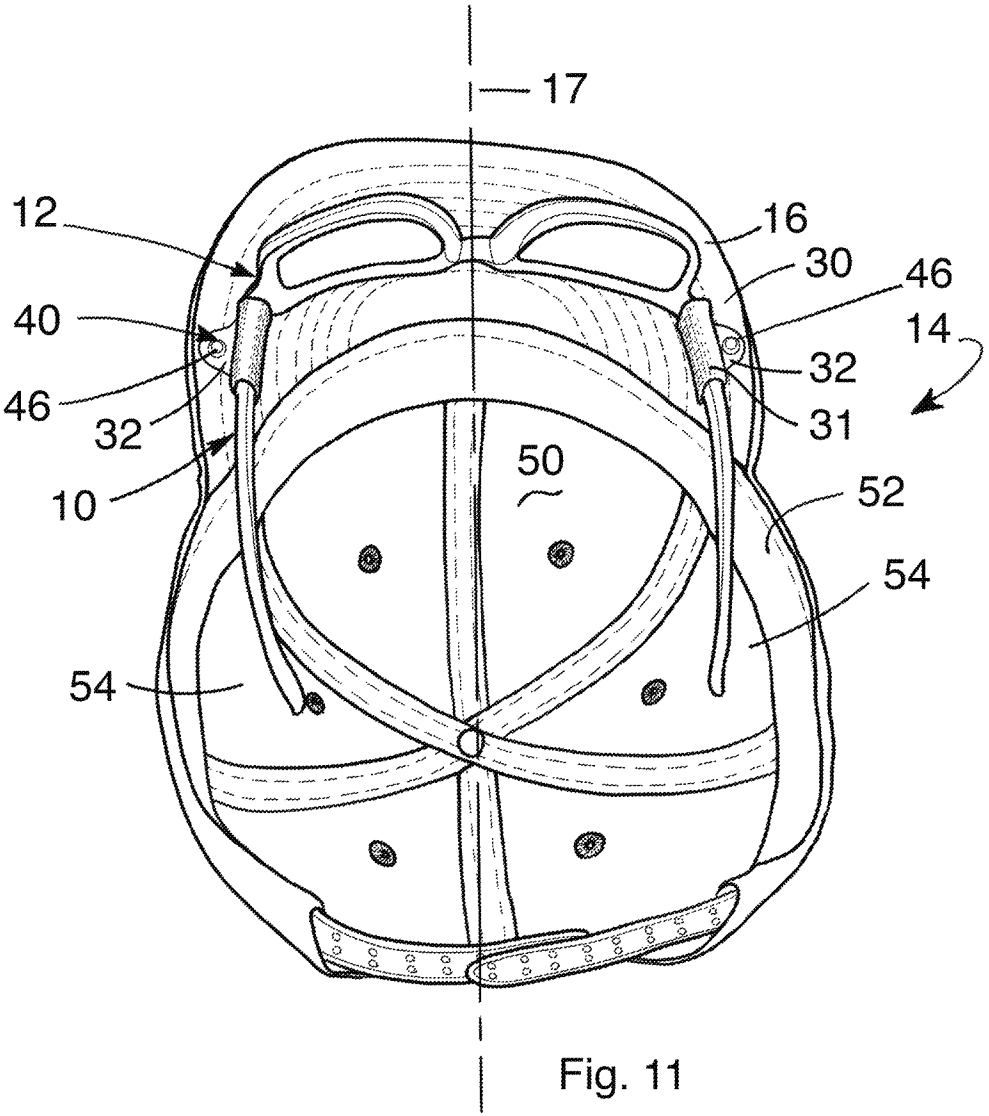
FIG. 11 is a bottom view of the hat of FIG. 10.
Figure 12:
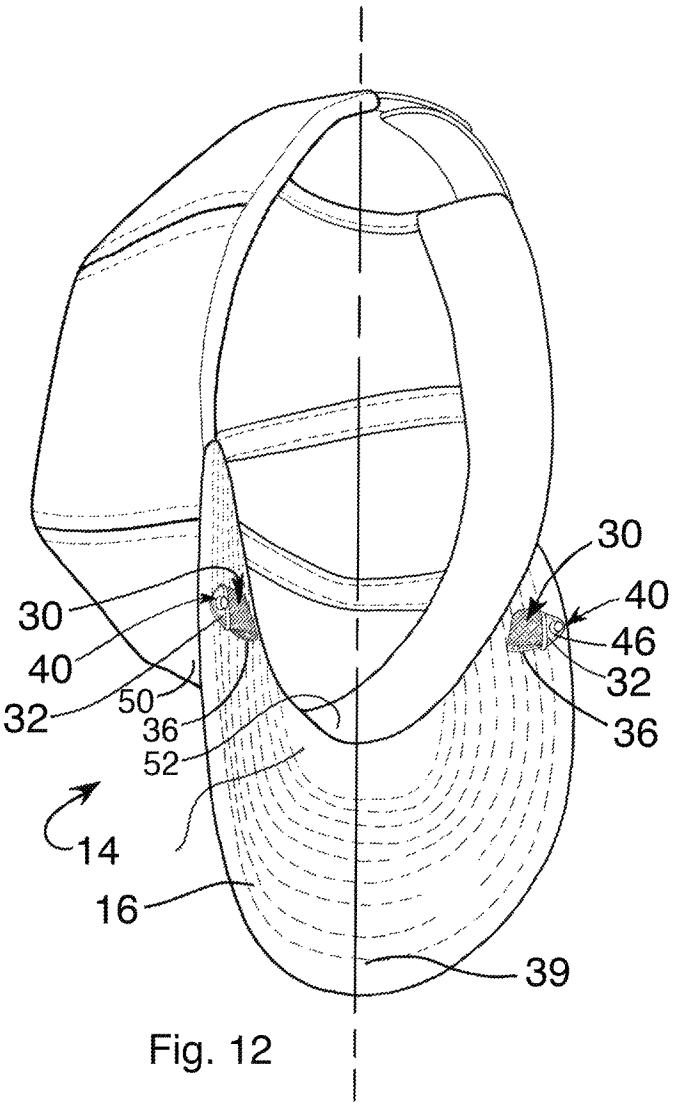
FIG. 12 is a bottom perspective view of the hat of FIG. 7, or the hat of FIG. 11 with no glasses.

A slide lock 38 encircles the tether 30 and specifically encircles both ends of member 31 at a location between the end piece 32 and the opening 36 at the end of the tether. The slide lock 38 is movable along a longitudinal axis 39 (FIG. 6) of the tether 30 in a direction from the base end piece 32 toward the opposing, distal end of the tether 30 when the tether 30 is stretched. The slide lock 38 is configured to hold together the ends of the refolded member 31 forming the tether 30 so that as the slide lock 38 approaches the distal end. Referring briefly to FIG. 8, the slide lock 38 is shown as comprising a generally rectangular frame with a middle bar 37*a* parallel to the two opposing and preferably parallel end frames 37*b*, 37*c*. A different end or side of member 31 passes through each resulting rectangular opening on opposite sides of the middle bar 37*a* so the slide lock is held between the joined ends held by end piece 32 and the loop forming opening 36, and thus cannot slide off the tether 30. Advantageously, the spacing between members 37*a*, 37*b*, and 37*c* are such that when the member 31 and tether 30 are stretched, the slide lock 38 can move along the length of the stretched tether, and when released the material 31 and tether 30 expand and hold the slide lock in place, while retaining the stretched loop forming opening 36 and enclosing temple arm 22 as discussed later. Thus, the distance between two adjacent sides 39 of the slide lock 38 are preferably closer together than the thickness of the two overlapping and refolded ends of member 31 so as to squeeze those ends together and lock them in position relative to each other in the un-stretched condition. In the depicted configuration, the long sides 39*a*, 39*b* or 39*b*, 39*c* of the rectangular slide lock 38 are closer together than the thickness of the member 31 enclosed by the slide lock—in the un-stretched configuration. When stretched, the looped member 31 and tether 30 shrink in cross-sectional dimension, allowing the slide lock 38 to move along a length of the members 31 and tether 30 with manual force.

Preferably, the refolded member 31 has inner and outer ends abutting each other between the end piece 32 and opening 36, with the slide lock 38 enclosing the outer periphery of a cross-section of the abutting inner and outer ends of member 31 and having the same, general cross-sectional shape as the abutting inner and outer members. In the depicted configuration, the slide lock 36 has a rectangular shape and squeezes the inner and outer ends of elongated member 31 toward each other with enough force to resist the elastic force of the stretched member 31 from releasing the stretch of the material forming the loop encircling opening 36 when stretched around the temple arm 22. Thus, the tether 30 and refolded elongated member 31 can be stretched, which reduces the thickness of the material 31 and allows slide lock 38 to be moved toward the end of the loop and opening 36, and when the stretch is released the material resumes its undeformed thickness which restrains the slide lock 38 from moving along a length of the tether 30 and which maintains the stretched portion of the tether outward of the slide bar 38 and the loop encircling the temple arm 22 and forming opening 36 through which the temple arm passes.

The stretching of the member 31 around the loop encircling most of the opening 36 comprises a way of adjusting the length of the elongated member 31 to frictionally engage the temple arm 22 passing through the opening 36. The slide lock 38 could just as easily comprise an adjustable length mechanism commonly found on backpacks and other bags to adjust the length of various straps to tighten the strap formed by elongated member 31, around the temple arm 22.

A fastener 40 connects the end piece 32 to the bill 16 of the hat 14. The fastener 40 preferably comprises releasably interlocking, male and female members, such as a post and clutch used on earrings and tie-tacks that are pinched between a thumb and finger and preferably squeezed to activate a mechanical release, or pulled off against friction retention, or unscrewed, or held by other releasable fasteners. As best seen in FIGS. 1-6 and especially FIGS. 6A-6B, the screw fastener 40 comprises a two part, releasable, threaded fastener connection. The first fastener part is shown as a male part having a first, enlarged head 42 with a post comprising threaded shaft 44 extending therefrom. The second fastener part or clutch, is shown as having an enlarged head 46 and a tube 48 configured to receive shaft 44 and releasable hold the shaft 44 by engaging mating internal threads in the tube 48 with external threads on the shaft.

By pushing on enlarged end 42 the first fastener 40 has the pointed end of its shaft 44 pressed through a first side of the bill 16 of the hat 14 at a location adjacent the juncture of the bill with the crown 50 and adjacent the front part of the sweatband 52 of the hat 14. The shaft 44 may be passed from the top of the bill 16 downward, or from the bottom of the bill upward. The fastener 40 connects to the bill 16 adjacent the two front panels and crown 50 of the baseball hat, with the bill 16 extending along the sides of the hat to the middle panels 54 of the hat. A second fastener 40 has its shaft 44 pressed through a second, opposing side of the bill 16 of the hat 14 at a location adjacent the juncture of the bill with the crown 50 and front part of the sweatband 52 of the hat. The end piece 32 has its hole 34 pass over the shaft 44 and then the shaft mates with tube 48 to connect the fastener parts and connect the end piece 32 and associated tether 30 to the underside of the bill 16. The hole 34 may be pre-formed or may be formed during use by passage of shaft 44 through the material 31 of tether 30 and through the end piece 32 (if present). The shaft 44 may have a sharp or pointed distal end for purposes of forming the hole 34 and for forming a hole through the bill 16 of hat 14 during use. The locations of the first and second fasteners 40 are preferably symmetrically located about longitudinal axis 17 of the hat extending through the bill 16. The threads on the shaft 44 are preferably self-threading threads and the recess in tube 48 may have a mating thread or may be sized so the threads on shaft 44 form receiving threads in tube 48.

Once a tether 30 is connected to the underside or lower side of bill 16, a different temple arm 22 is passed through a different one of the tethers 30. Thus, a first temple arm 22 is passed through the opening 36 of a first tether 30 on a first side of the bill 16, and a second temple arm 22 is passed through the opening 36 of a second tether 30 on an opposing, second side of the bill 16. As the temple arms 22 pass through the openings 36 of tethers 30 on opposing sides of the hat 30, the position of the arms and associated eyeglasses 12 may be moved along the length of longitudinal axis 17 of the hat to adjust the relative positions of the hat and eyeglasses. If the location of the tethers 30 are inadequate to achieve the desired position of the eyeglasses the fasteners 40 may be relocated by pressing the shaft 44 through the bill 16 at a more desirable location. Thus, the openings 36 in tethers 30 cooperate with the temple arms 22 to adjust the position of the eyeglasses 12 relative to the hat 14 and relative to the user's face, and particularly relative to the user's nose and ears which engage the eyeglasses 12 when the hat 14 is on the user's head so the frame rim 20 rests on the user's nose and the temple arms 22 and/or tips 26 rest on the user's ears.

Once the eyeglasses 12 are positioned relative to the user's head with the hat on the user's head, the tethers 30 are preferably tightened to hold each tether 30 to the location on the temple arm 22 encircled by each tether 30. This tightening is achieved by moving the slide lock 38 toward the end of the tether 30 and toward the encircled temple arm 30. If the material forming the tether 30 is elastic and if the tether is stretched while slide lock 38 is moved so narrows the loop and opening 36 and pushes the member 31 against the encircled temple arm 22, then when the stretched material is released the slide lock 38 will lock the stretched portion into place while allowing the portion between the end piece 32 and slide lock 38 to relax, while retaining the stretched portion of the tether that tightly encircles and locks against the encircled temple arm.

Figure 3:
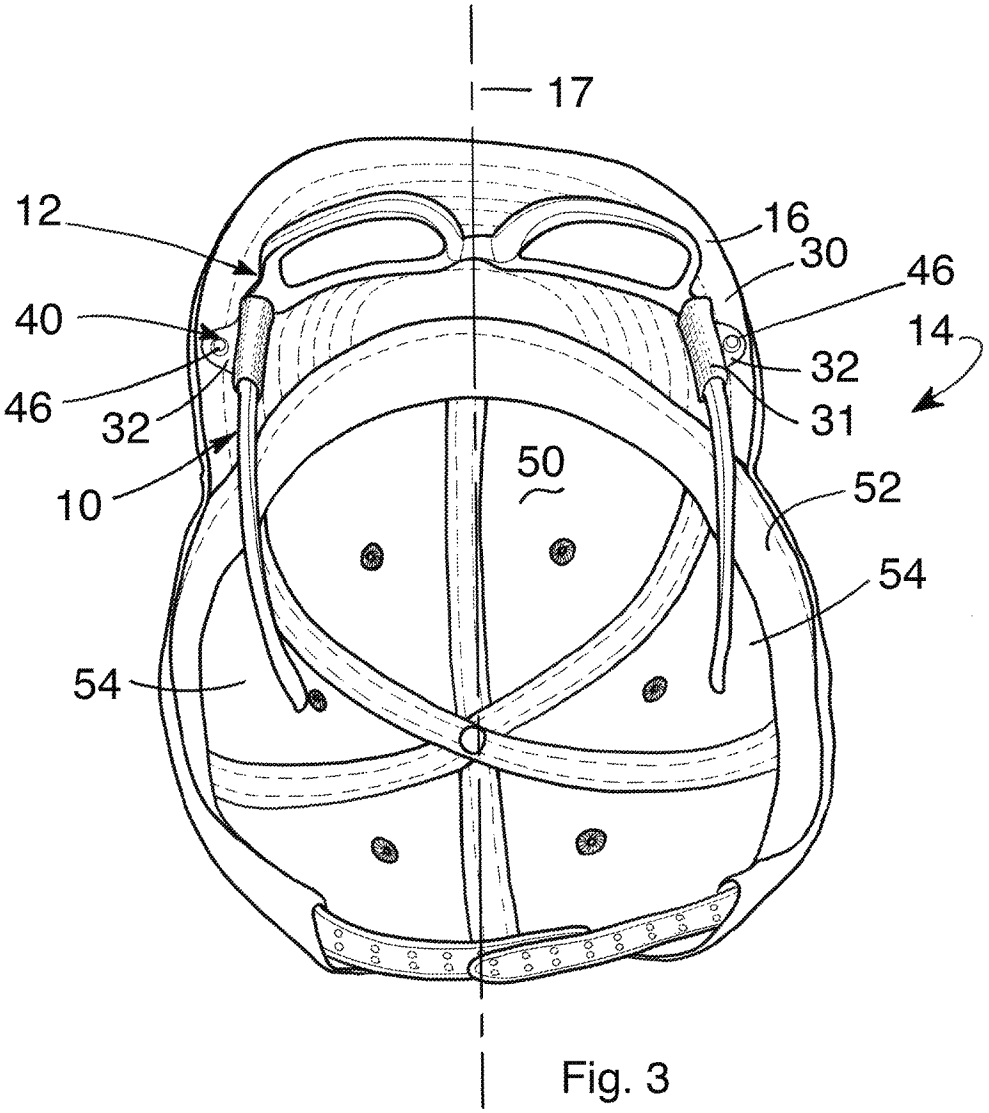
FIG. 3 is a bottom view of the hat and eyeglasses of FIG. 1.
Figure 4:
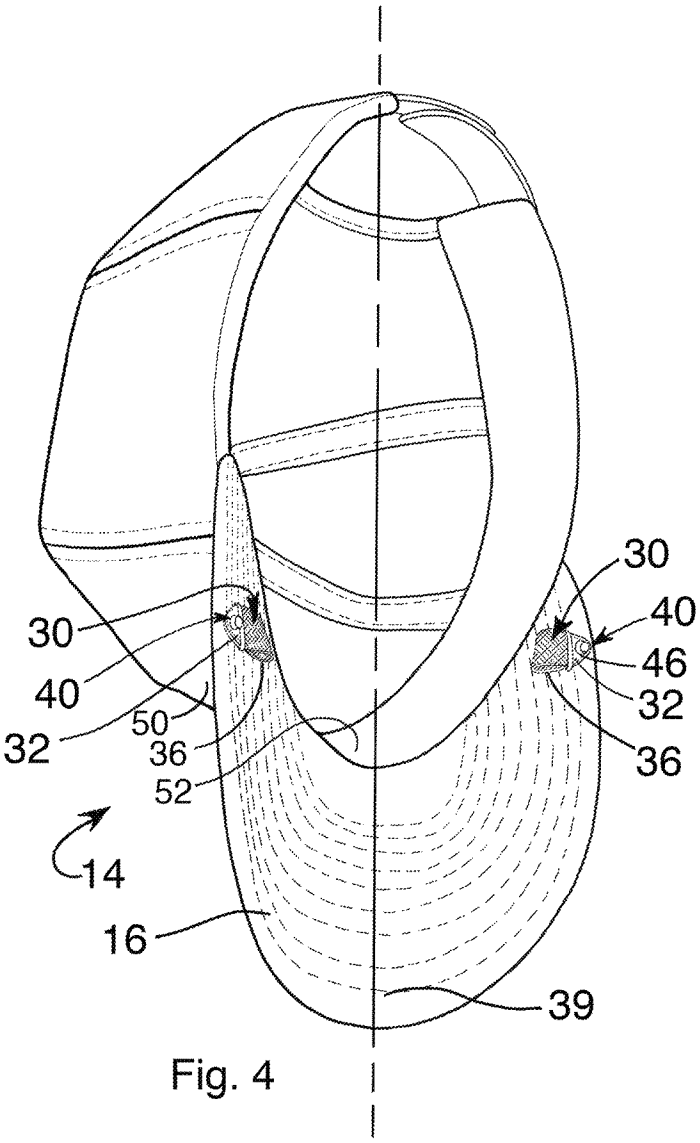
FIG. 4 is a perspective view of the bottom of the hat of FIG. 1 showing the underside of the hat with two flexible tethers.

Each tether 30 may be stretched by pulling the temple arm 22 passing through the tether, in a direction away from the fastener 40 attaching the tether to the bill 16 of the hat, relying on the fit of the hat 14 with the user's head to hold the fastener 40 relatively stationary and thus use the temple arm to stretch the elastic member 31 of tether 30. In the orientation of FIGS. 1 and 3, the temple arms 22 are pulled downward. When the tether 30 and elastic member 31 are stretched, the slide lock 38 is moved toward the opening 36 and temple arm 22, whereupon the stretching is released. The slide lock 38 thus cooperates with the elastic tether 30 to provide a friction connection between the temple arm 22 and the encircling tether 30 at a selected location along each of the temple arms 22. The positioning of the slide lock 38 to tighten the tether 30 and tightly encircle the temple arm 22 thus provides a releasable lock to releasably hold the tether to the temple arm. The sliding lock 38 acts as a cinch to lock the tether 30 in place around the temple arm 30. An elastic tether 30 makes the cinch tighter but is not believed necessary.

To release the tethers 30, each tether may be stretched by again pulling the encircled temple arm 22 away from the fastener 40 associated with the tether 30 to stretch the material 31 and release the arm 22. Alternatively, because the tethers 30 hold the temple arms 22 by friction, a user may pull the temple arm 22 and temple tip 24 through the opening 36 of the tether—but doing so risks tearing the material 31 forming tether 30 if part of the temple arm 22 or tip 24 is larger than the cinched opening of the tether 30 and depending on how tight the sliding lock 38 was tightened.

The inner surface of the tether 30 facing the temple arm 22 may advantageously have a high friction surface, such as rubber or a flexible polymer that is selected to have a high frictional engagement with the material of the temple arm 22. The material of the tether 30 may thus change depending on the known or anticipated material used in intended temple arm 22. The inner surface of tether 30 facing the temple arm 22 may also have a textured surface, such as a knurled surface, to increase frictional resistance to the sliding of the temple arm 22 through the tether 30. If the tether 30 is made of a flat material to contact a short length of the temple arm 22, then both opposing sides of the tether 30 may be textured for high friction. If the member forming tether 30 does not have distinct, opposing inward and outward facing surfaces (e.g., a circular cross section), then the entire outer surface of the tether may be textured to increase friction and reduce sliding of the temple arm 22 through the tether 30.

In use, a fastener 40 and its connected tether 30 are attached to each opposing side of the bill 16 of a hat 14 by manually pressing the sharp head of the shaft 44 through the bill of the hat and then using the female tube 48 to fasten the tether to the fastener 40 and the bill of the hat. If the bill 16 is too hard to manually press the shaft 44 through the bill then a pilot hole or passage hole may be drilled at a desired location. The tether 30 extends downward if the hat is oriented as in FIGS. 1 and 3. A different temple arm 22 of eyeglasses 12 is passed through a different one of the openings 36 in tethers 30 with the eyeglasses 12 and the bridge of the eyeglasses adjacent the underside of the bill 16 of the hat 14, and with the temple arms 22 extending along opposing sides of the bill 16 and along opposing sides of the hat 14 in a direction from the bill of the hat to the closure or back strap of the hat, or in the direction from the front to back of the hat. The user then puts on the hat and moves the eyeglasses 12 relative to the hat and user's head until the eyeglasses are in a comfortable position or use position, and the hat is in a comfortable position or use position. The slide lock 38 is then used to tighten the loop encircling each temple arm 22 to connect the tether to the temple arm at a desired location.

The fasteners 40 are passed through the bill 16 of the hat 14 at locations spaced apart a distance corresponding to the distance between the temple arms 22 of a user's eyeglasses. The width of a person's eyeglasses and the distance between the temple arms 22 varies with the person, e.g., child vs adult, large head vs small head, wide spaced eyes vs narrow spaced eyes, large frames vs small frames. The ability to move fasteners 40 to achieve different lateral spacing and distances between the fasteners, allows use with eyeglasses of different width. The length of the tethers 30 also allows some variation in lateral spacing between the temple arms 40. The fasteners 40 are also positioned along the longitudinal axis 17 so the temple arms are connected to the tethers at a desired location.

The fasteners 40 preferably pass through the bill 16 of a cloth hat 14 because the bill is stiffer than the body of a cloth hat or visor and the lateral spacing between the two fasteners 40 will remain substantially the same if they pass through the stiffer bill of the hat. If the fastener 40 is connected to the body of a cloth hat 14 then the flexible material may readily move toward or away from the longitudinal axis 17 of the hat and may cause motion of the temple arms and glasses as the hat is removed or put on a user's head.

Figure 2:
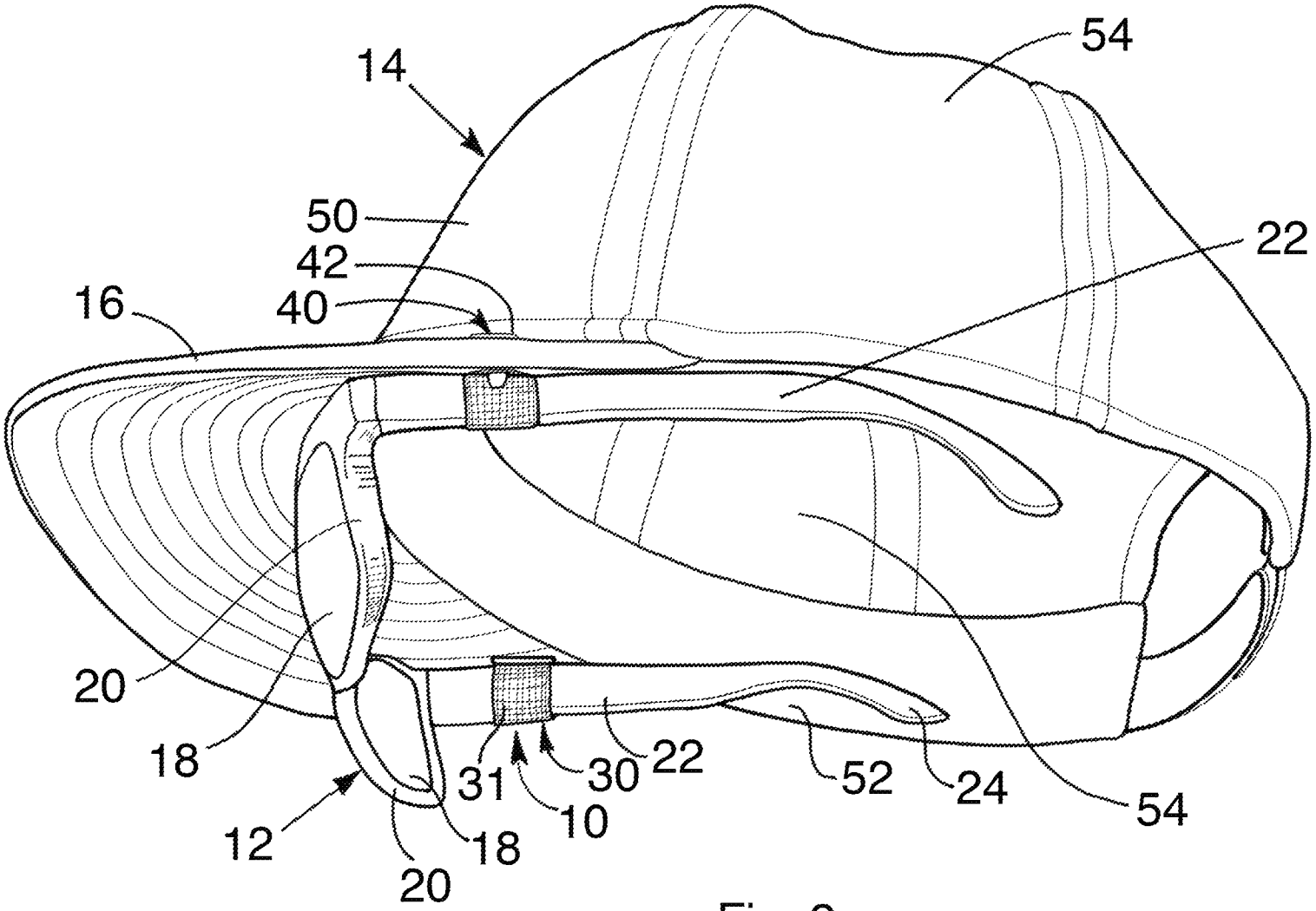
FIG. 2 is a perspective view of the hat and eyeglasses of FIG. 1 showing the underside of the hat.

Referring to FIGS. 2-3, the fasteners 40 are located on opposing sides of a vertical plane through the longitudinal axis 39, at a location adjacent the juncture of the bill 16 with the body of the hat. This location will typically put the fasteners 40 and tether 30 in a vertical plane passing through the user's eyes. This location corresponds to a distance along axis 39 of about ¾ to about 2 inches from the front rim 20 of the eyeglasses 12. The exact location may vary by user preference but the described location is believed to represent a desirable location for connecting the temple arms 22 to the hat 12. But user preference may locate the fasteners 40 anywhere along the bill 16 of the hat, and thus in front of the plane passing through the user's eyes during use, or on the side toward the user's ears, during use.

FIG. 2 shows the eyeglasses 12 with the top of the front rims abutting or immediately adjacent to (i.e., within an inch) of the underside of the bill 16 of the hat, and with the temple arms 22 extending below the bottom edge of the hat. The relative orientation and location of the eyeglasses 12 relative to the hat 12 will vary with user preferences. But advantageously the length of the tethers 30 are short, about 1-4 inches, and more preferably about 1-2 inches, so that the top edge of the temple arms may be near the bottom of the rim 16. As the temple arms 22 move further below the rim 16 and bottom of the cap 16, the flexibility of the tether 30 becomes more important. The tether 30 is preferably flexible in both its axial direction along the length of the looped member, and in the lateral directions orthogonal to the length of the member. As used herein, the term flexible in the lateral direction means a material sized for use that can repeatedly bend completely back on itself without breaking, or buckle without breaking, and can be bent or buckled as described with a low force measured in fractions of a pound and preferably measured in fractions of an ounce and more preferably with a force of less than about 10 grams. The lateral flexibility allows the eyeglasses 12 to remain comfortably on a user's head during use and allows lateral movement of the eyeglasses relative to the hat or user, as when a user rotates the hat on the user's head relative to the eyeglasses which remain in a stationary position.

The tether 30 is also preferably stretchable in the axial direction along a length of the tether by an amount that allows the tether to be cinched tight to temple arms 30 of different size. An axial elongation of about 5-50% or more at a force of about 0.5 to 3 pounds or less is believed suitable. The length and flexibility of the tether 30 advantageously cooperate to allow the user to wear both the hat and eyeglasses while removing the eyeglasses by removing the hat by lifting the bill of the hat with a single hand. The lateral flexibility allows movement of the hat relative to the eyeglasses and head during use. The axial flexibility allows the tether to cinch tight to temple arms 22 of different size, while pulling the eyeglasses with the hat when the hat is removed. If the tether 30 is too long or too elastic then it begins to act as a rubber band and may snap the eyeglasses against the hat and the user's arm or hand during removal of the hat and that is believed undesirable. Also, if the elasticity of the tether 30 is too high, then there is a lack of coordinated movement between the hat and eyeglasses when a user removes the hat. But the elasticity also allows an easy way to cinch or tighten the tether around the temple arms at the opening 36. Thus, the right amount of axial elasticity of the tether is regulated so the eyeglasses effectively move with the hat as the that is removed, with the lateral flexibility allowing comfortable wearing of the hat and glasses. It is believed that the tether 30 could have little or no axial elasticity while providing lateral flexibility as with a flexible cord or flexible strip of material—but this is less desirable.

If the hat 14 is removed from the user's head, the eyeglasses 12 remain connected to and move with the hat. As the temple arms 22 are connected to the bill 16 of the hat, the removal of the hat by grabbing the bill and moving it upwards (and optionally upwards and backwards) to remove the hat from the user's head will remove the eyeglasses 12 without harming the user and in a way that is believed not uncomfortable for the user. Because the eyeglasses 12 are connected to the hat 14, the system 10 allows a user to quickly remove both eyeglasses and hat with one motion of one hand. As the hat is larger and more visible than the eyeglasses the system 10 helps locate the eyeglasses (via the hat) and reduces the likelihood of misplacing the eyeglasses or losing the eyeglasses. As the hat is larger than and more visible than the eyeglasses, the system 10 reduces the likelihood that someone will accidentally step on the eyeglasses (and hat). As the hat is connected to the eyeglasses, the system 10 offers the possibility and in some cases the likelihood that the hat will protect the lenses 18 from scratching when the hat and eyeglasses hit the ground, so the system 10 may reduce scratching or other damage to the lenses and eyeglasses. Because the eyeglasses 12 are connected to the hat 14, the eyeglasses are more difficult to unintentionally dislodge from the user's head and thus the system 10 may provide an improved way of securing the eyeglasses to the user for sports and other activities.

Figure 5:
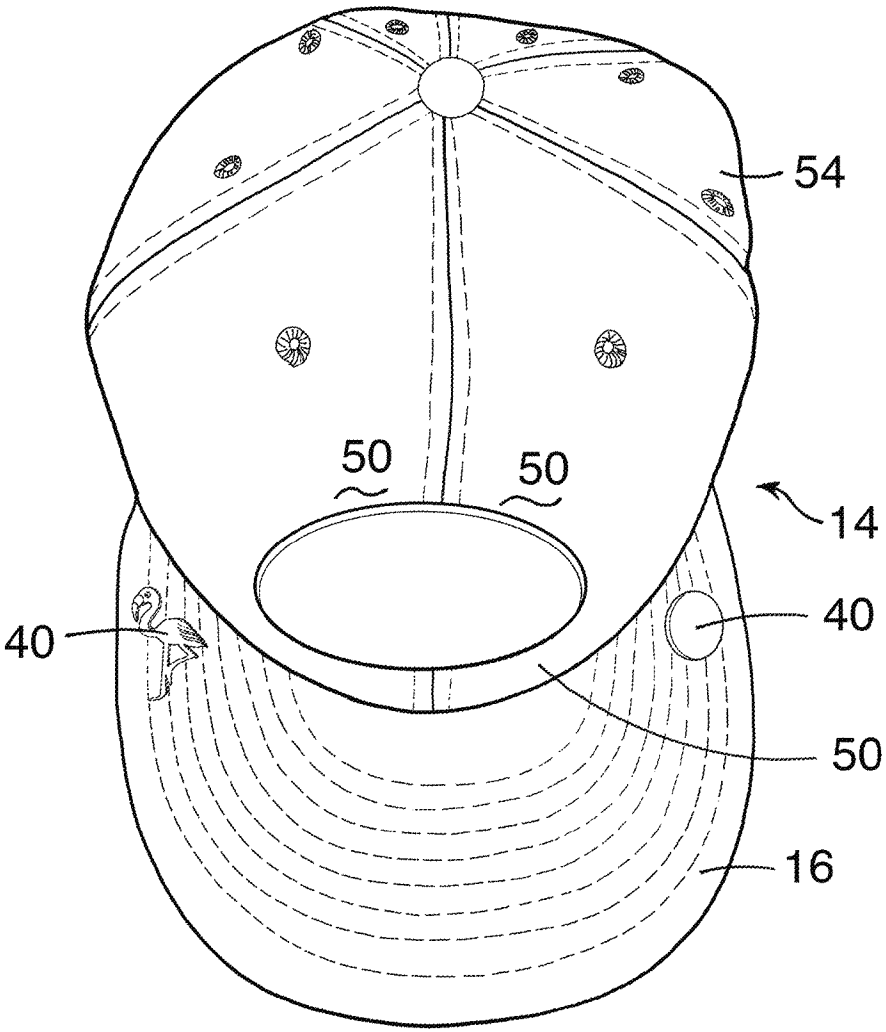
FIG. 5 is a top view of the hat of FIGS. 4A and 4B.
Figure 6B:
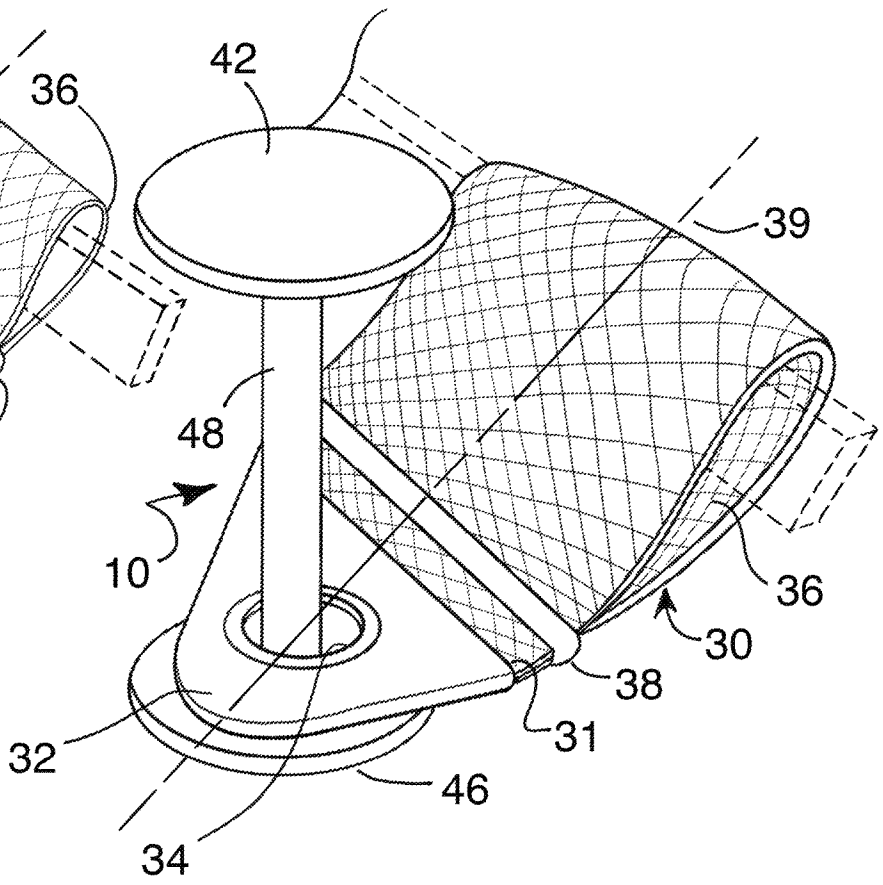
FIG. 6B is an assembled view of the fastener and flexible tether of FIG. 6A.
Figure 6A:
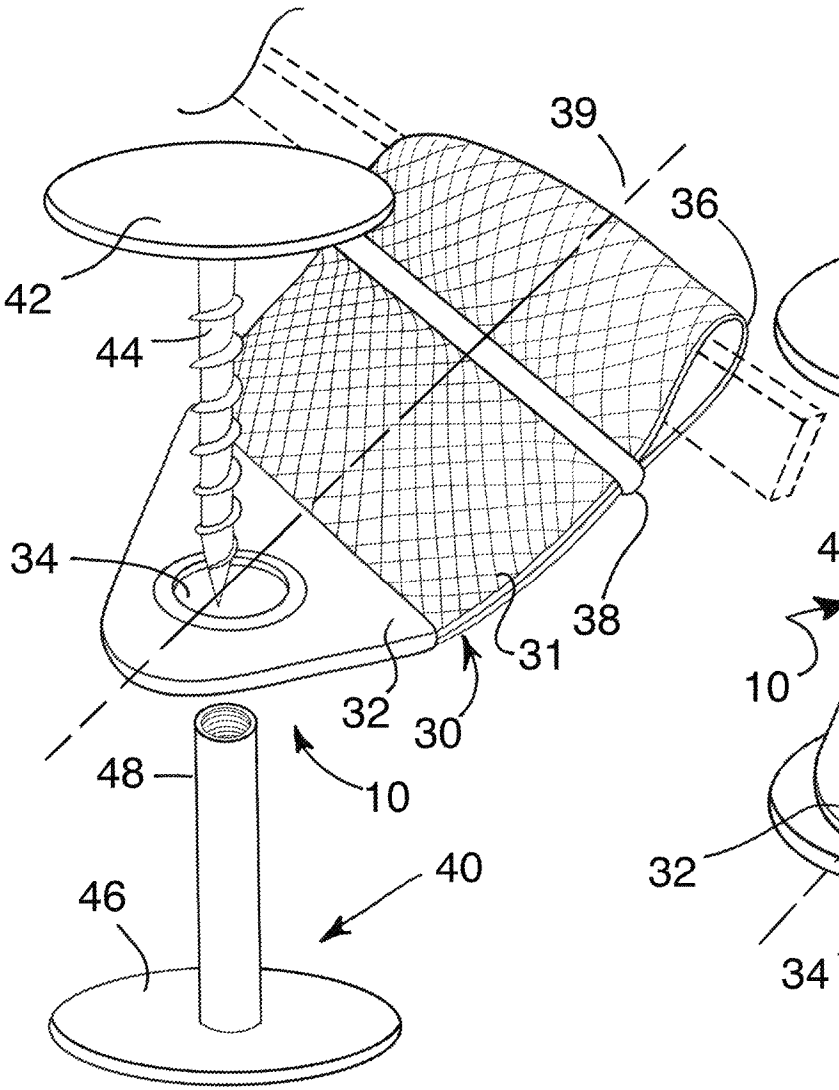
FIG. 6A is an exploded view of a fastener and flexible tether.

Depending on the thickness of the bill 16 and the end piece 32, the length of the shaft 44 and mating tube 48 will vary. While the heads 42 are shown as flat, circular discs in FIGS. 6A-6B, the heads 42 may be any shape or configuration. Thus, for example, a head 42 having a flamingo shape is shown in FIG. 5. One or both of the heads 42, 46 lend themselves to promotional usage, as the heads may be configured to depict baseballs or baseball gloves for use by baseball fans, footballs or helmets for use at football games, or configured as soccer balls, basketballs, tennis balls, or other sports equipment. The heads 42 may also be configured to depict the logos of various sports teams, as well as animals, cartoon characters, farm equipment, or other articles that a user may find desirable to depict on the user's hat or that others may find desirable for marketing purposes. While the head 42 is shown on the top of the bill 16, the fastener 40 could be inserted from the bottom of the bill upwards which would put the head 46 on the top of the bill, with the tether 30 remaining on the underside of the bill 16.

The above embodiments are believed especially useful with a baseball hat. But the design is equally usable with a hat 14 having a hard shell. Thus, while the description is provided for a hat with a soft body and stiffer bill 16, the flexible tether 30 and fasteners 40 are usable with other hats.

Figure 7:
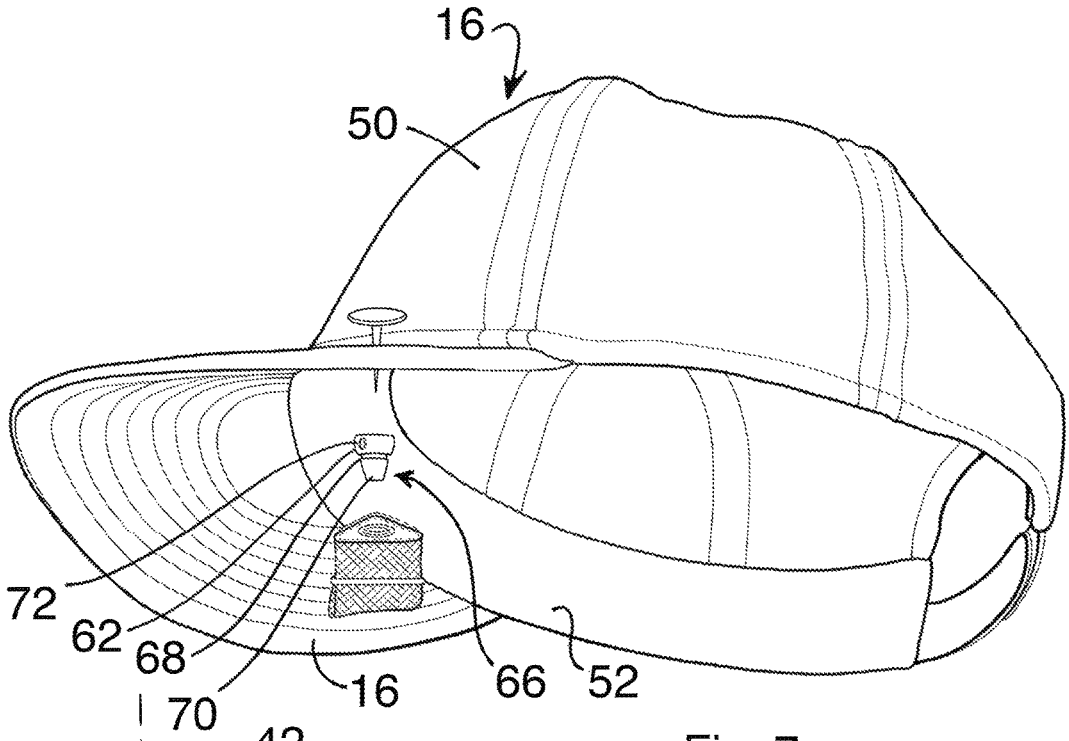
FIG. 7 is a lower perspective view of a hat having an exploded view of a second embodiment of a fastener, a clutch having a receiving portion and a projection, and flexible tether releasably connected to the projection.
Figure 13B:
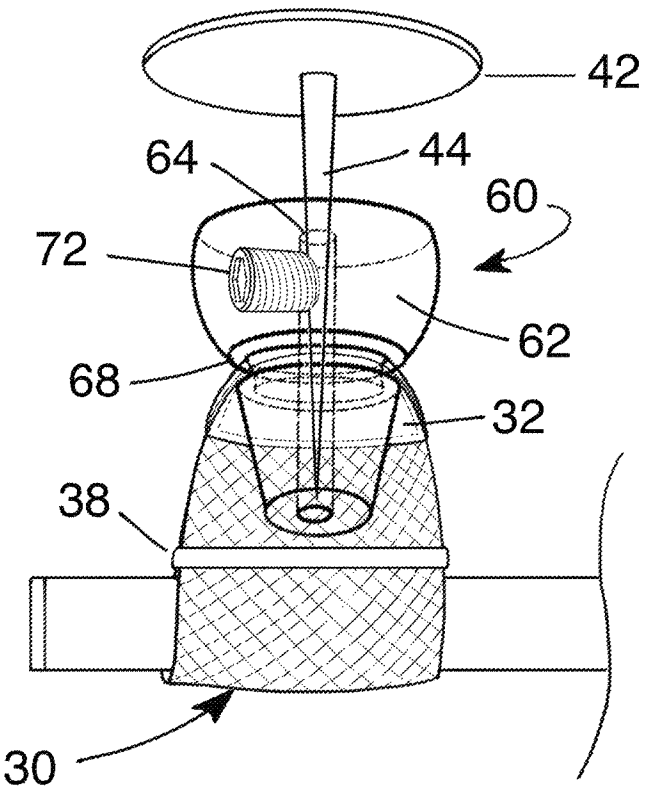
FIG. 13B is an assembled view of the fastener, clutch and tether of FIG. 7, with part of a temple arm through the tether.
Figure 13A:
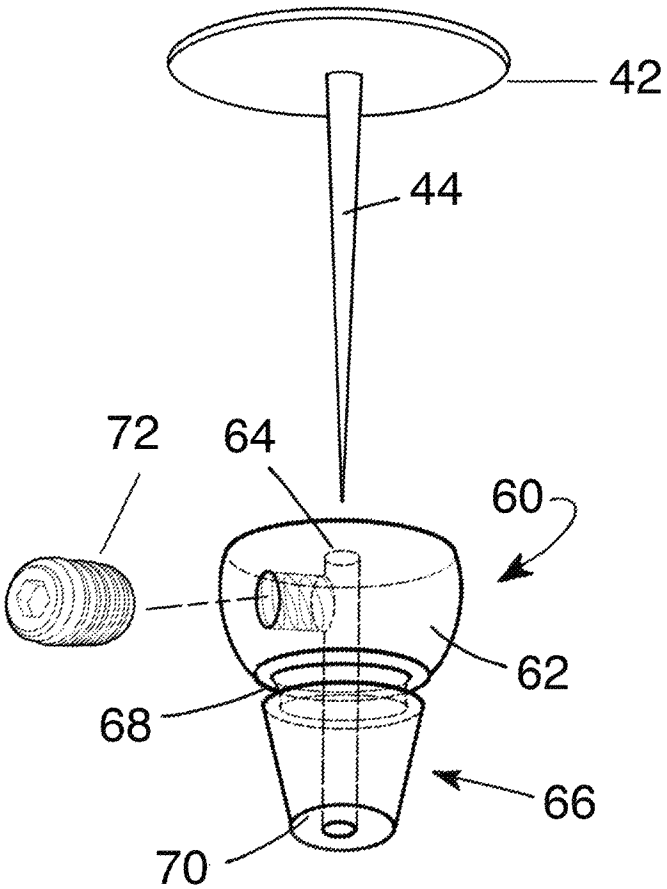
FIG. 13A is an exploded view of the fastener and clutch of FIG. 7.

Referring to FIGS. 7-13, and especially to FIGS. 7-8 and 13, a further variation of the fastener 40 is shown for connecting the tether 30 to the bill 16 of the cap 14. The fastener 40 has a first part with an enlarged head 42 and post or shaft 44 with a pointed end for penetrating the bill 16 of the hat. The female portion of the fastener 40 comprises a clutch 60 having an enlarged head 62 containing a longitudinal bore 64 configured to receive shaft 44. The clutch 60 has a shaft or male projection 66 (FIG. 13A) with a groove 66 encircling the circumference of the projection 64 and a rounded or tapered end 68 outward of the groove.

The end 68 passes through hole 34 in end piece 32 so the body of the end piece 32 engages the groove 68. The clutch 60, head 62 and male projection 66 are preferably of a resilient polymer material so the end 66 may be compressed slightly to fit through the hole 34 and allow the body of end piece 32 to fit in the groove 68. The clutch 60 could be of metal with the end 70 slit into segments (e.g., 2 or 4 segments by one or two slits) so the end 70 can compress and pass through the hole 32 whereupon the end enlarges to prevent the hole 34 from easily passing over the expanded end 70. The expanded end 70 forms a snap fit with the hole 34 in the end piece 32 to releasably connect the parts together. The user may disengage the end piece 32 and tether 30 from the fastener 40 by pulling the end piece 32 off the end 70, causing the end 70 to slide through the hole 34. In this embodiment, the clutch has both a female receiving portion to receive shaft 44 of fastener 40, and a male engaging portion 66 with end 70 to releasably engage hole 34 of tether 30.

The bore 62 releasably engages the shaft 44. The clutch 60 may be of an elastomer with the bore 62 sized smaller than the shaft 44 to frictionally engage the shaft and allow the heads 42, 62 to squeeze opposing sides of the bill 16 together to secure the fastener 40 to the bill of the hat 14, with the male projection 66 extending downward below the bill 16 to releasably engage the end piece 32 of the tether 30.

Alternatively, the clutch 60 may have an internal, spring-actuated engagement mechanism, such as that shown in U.S. Pat. No. 4,184,343, the complete contents of which are incorporated herein by reference. The enlarged head 62 may have a radially extending and spring biased pin (not shown) with a circumferential groove (not shown) resiliently urged to frictionally engage shaft 44 and releasably hold the shaft to the clutch 60. Pushing on the end 42 of the pin moves the pin against its biasing spring to a position where the groove on the pin disengages the shaft 44 to disengage the pin and shaft and allow the fastener 40 to be removed from the bill 16 of the hat 14. Other mechanisms may be used to releasably connect the projection 66 to the hat.

Referring to FIGS. 13A-13B, the shaft 44 of fastener 40 may be connected to the clutch 60 by a set screw 72 in the same radial location as the end 42 of the above described pin. The base of the clutch 60 adjacent the underside of the bill 16 of the hat, has a threaded, radial passage into which set screw 72 may be threadingly engaged to wedge against a side of the shaft 44 of the fastener 40 and securely connect the fastener to the clutch 60. The set screw 72 is shown with an allen head recess to tighten and loosen the screw, but other recess shapes can be used, including screwdriver slots and recesses.

In use, the shaft 44 is positioned at a desired location along one edge of the bill 16 of the hat 14 and then manually pushed through the bill of the hat. The clutch 60 releasably engages the shaft 14 to hold the shaft 44 in place. The end piece 32 of tether 30 is releasably connected to the clutch 60 by passing the compressible and expandable end 70 through the hole 34 of the end piece in a snap-fit connection. The temple arm 22 is then passed through the hole 36 formed by the looped ends of elongated member 31, with the slide lock 38 preferably tightened against the temple arm to more securely engage the tether 30 with the temple arm. As described in more detail herein, the tether 30 is preferably stretched as the slide lock is slid toward the arm 22 and the stretched tether is released after the slide lock 38 is cinched against the temple arm. A similar fastener 40 and clutch 60 are used for the other temple arm 22 on the other side of the bill of the hat. The tether can be re-stretched and the slide lock 38 released and the tether 30 disengaged from the clutch 60 in order to reposition the shaft 44 of fastener 40 to relocate the position of tether 30 relative to the bill 16 of the hat 14.

Alternatively, the tether 30 may be left engaged to the temple arm 22 and the end piece 32 of the tether may be disconnected from the clutch 60 by passing the hole 34 over the end 70 of the clutch—after which the fastener 40 and shaft 44 may be repositioned. The clutch 60 with projection 66 may be used to quickly disengage the tether 30 from the hat 14, while leaving the tether connected to the eyeglasses 12. That provides more flexibility in the use of the eyeglasses as well as allowing use of the hat without the glasses.

Referring to FIGS. 14-17, a clip variation is shown for releasably fastening the tether to the bill of the hat. The clip 80 resembles a money clip and comprises a piece of metal or plastic having a two opposing sides 82*a*, 82*b* of about the same length or with one side (top side 82*a*) slightly longer than the opposing (bottom side 82*b*). The sides 82 join at a base 84 and are preferably resiliently urged together at their distal end, opposite base 84. If made of metal the sides 82 may be bent to resiliently urge them together. If made of plastic or metal, the distal ends may be abutting or close together so that separating them urges them together. The sides 82 are long enough that they act as leaf springs resiliently urging the distal ends toward each other when separated—as occurs then the ends are slid over opposing sides of the bill 16 of a hat. The clip 80 is preferably small in size, having sides about 0.5 to 1 inch wide and about 0.5 to 1 or 2 inches long, with the sides 82*a*, 82*b* spaced apart a distance of about 0.1 to about 0.3 inches at the base 84—wide enough to accommodate the thickness of the bill 16 of the hat. The base 84 is preferably contoured to match the edge of the bill 16 of the hat, and is thus typically rounded or square. One or both distal ends of the sides 82 may be curved in a direction away from the other side to make it easier to pass the edge of the bill 16 between the ends of the clip. In FIG. 14C, the distal end of the lower side 82*b* is shown curved.

The bottom side 82*b* of the clip 86 preferably has a few holes 86 sized to receive a threaded fastener 88, such as set screw or a screw with a head. The holes 86 may be located on an offset area 90 parallel to but offset from the general plane of the back side 82*b*. The offset area 90 preferably extends along a longitudinal axis of the clip and its sides 82, with the holes 86 located along that axis and on the offset area. The offset 90 allows more compete engagement with threads in the holes 86 and fastener 88 and a more secure connection.

During use, the threaded fastener 88 passes through hole 34 in the end piece 32 of tether 30 and then into one of the plurality of holes 86 to fasten the tether 30 to the clip 80. In the drawings, the hole 34 in end piece 32 is sized and threaded to threadingly engage set screw 86. Optionally, the threaded fastener 88 could have a head larger than the hole 34.

The use and location of the clip 80 is very similar to that of the fastener 40 except for the way the clip 80 fastens to the bill 16 of the hat 14 and that prior description is not repeated. To use the clip 80, sides 82*a*, 82*b* are spread apart so they pass on opposing sides of the bill 16 of the hat, and the base 84 is pushed against the bill of the hat at a desired location along the brim or bill 16 of the hat 14. The sides 82*a*, 82*b* are resiliently urged against opposing sides of the bill 16 to hold the clip 80 in position on the bill of the hat. As needed, the sides 82*a*, 82*b* may be spread apart and the clip 80 repositioned. The short side 82*b* with the optionally curved end is preferably on the bottom of the bill 16 of the hat, so the tether 30 hangs downward. A clip 80 and attached tether 30 are provided on opposing sides of the bill of the hat. A temple arm 22 is passed through the opening 36 in the tether on each side of the hat and the hat may then be placed on the user's head. The slide lock 38 is slid toward the end of the tether and toward the arm 22 to tighten or narrow the opening 36 and secure the tether to the arm. Advantageously, the material 31 is stretched and the slide lock 38 fastens the tether 30 in position while the material is stretched to more tightly cinch the tether to the temple arm 22. The hat is preferably off the user's head when passing the arms through the tether 30 and the slide locks 38 are used to tighten loops 36 around their respective temple arms 22.

Figure 14A:
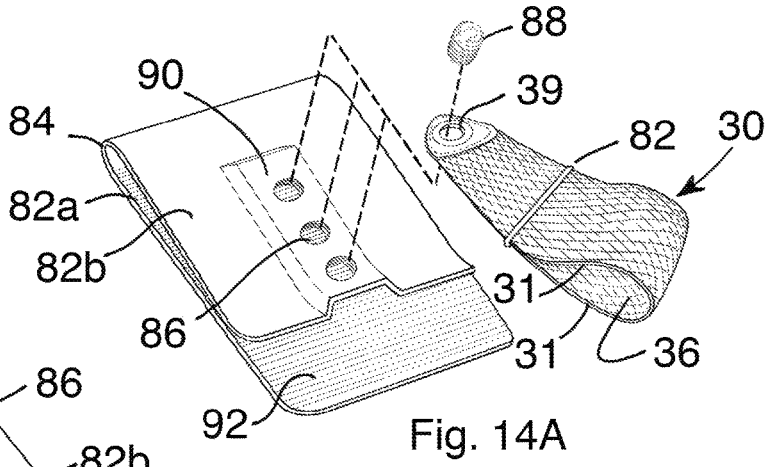
FIG. 14A is an exploded perspective view of a further embodiment for connecting a tether to the hat, showing a tether and clip.
Figure 14B:
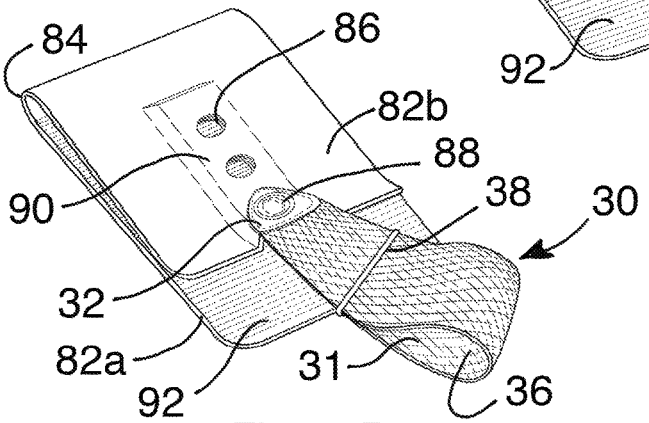
FIG. 14B is a perspective view of the tether and clip of FIG. 14A in an assembled configuration, showing the bottom side of the clip.
Figure 14C:
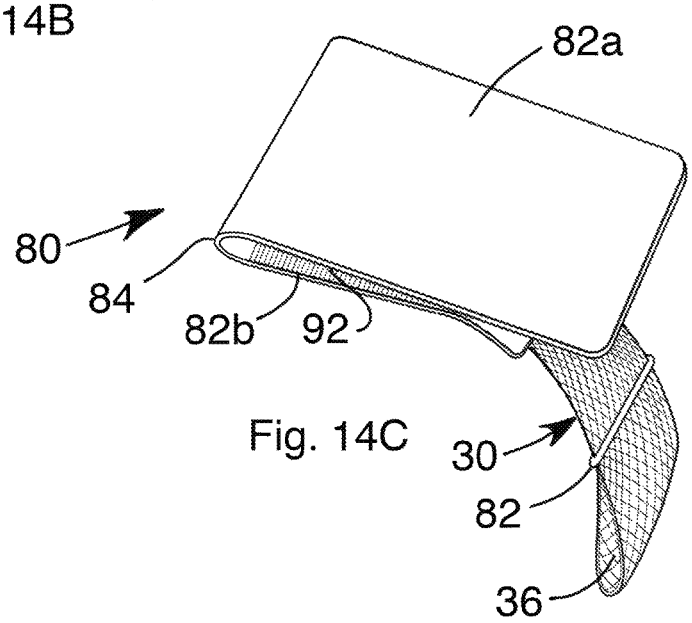
FIG. 14C is a perspective view of the clip of FIGS. 14A and 14B showing the opposing, top side of the clip.
Figure 15:
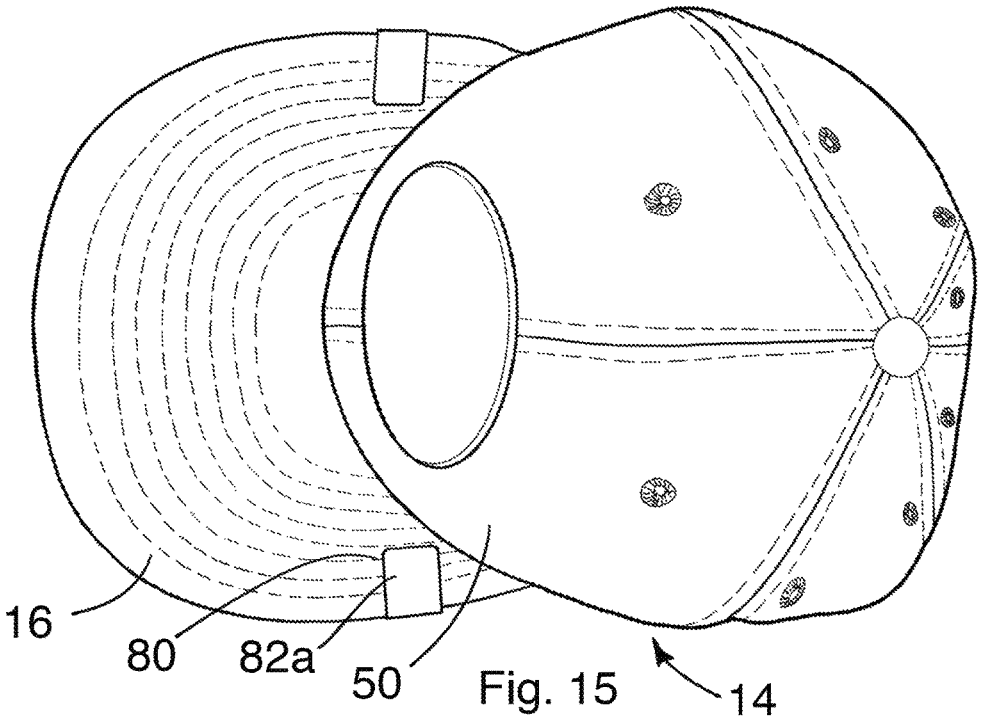
FIG. 15 is a top view of a hat having the clip of FIGS. 14A to 14B on opposing sides of the bill of the hat.
Figure 16:
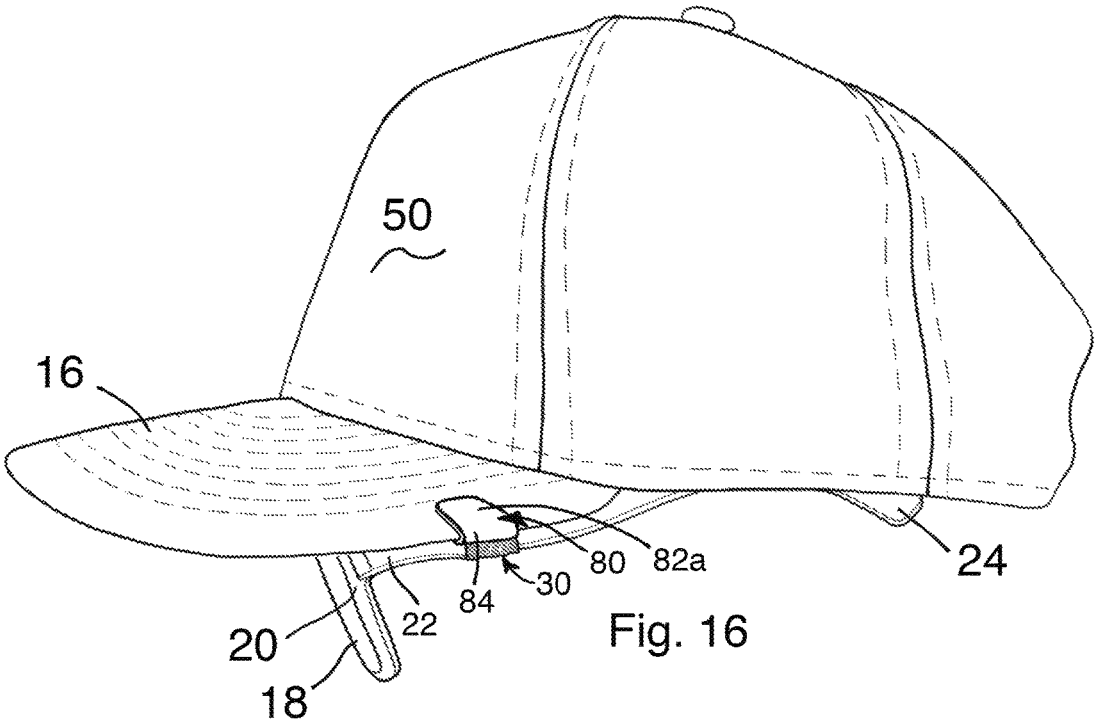
FIG. 16 is a side view of the hat of FIG. 15 with glasses held in the tether.
Figure 17:
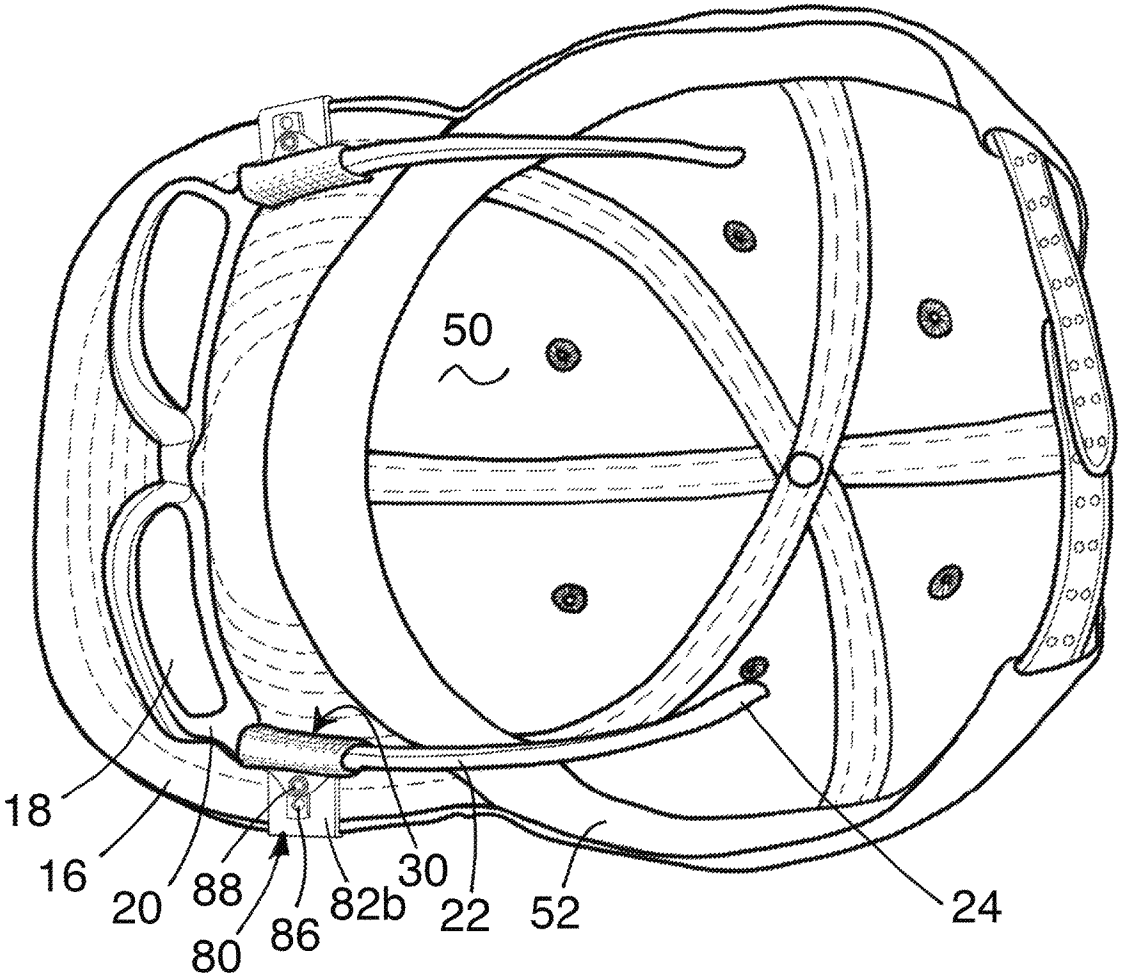
FIG. 17 is a bottom view of the hat and glasses of FIG. 17.

As best seen in FIG. 14A, 14B, the inner surface of the sides 82*a*, 82*b* may have a surface texture 92 to better grip the abutting surface of the bill 16 of hat 14. A knurled surface, alternating ridges and valleys inclined to resist sliding off the bill 16, a barbed surface or other gripping textures are believed suitable. The surface texture 92 could also be achieved by using a rubber or elastomer coating selected to have a high coefficient of sliding friction with the planned material on the outside of the bill 16 of hat 14.

The temple arm 22 is moved through the opening 36 of the tether 30 until the tether is in the desired position on the user's head—relative to the longitudinal axis 17. If the two temple arms 22 on the eyeglasses 12 are too far apart or too close together relative to the tethers 30, then the tether 30 and locking fastener 88 can be placed through a different hole 86 in the clip 80. If needed, the clip 80 may be removed and relocated, with the fastener 88 and end piece 32 of tether 30 fastened to whichever hole 86 seems appropriate in order to move the end piece 32 and associated tether 30 toward or away from the edge of the bill 16 of the hat. Thus, the plurality of holes 86 allow the location of the tether 30 to be adjusted in a lateral position toward and away from a medial plane through the nose and between the eyes of the user, or adjusted laterally toward or away from the edge of the bill 16 of the hat. Likewise, by moving the clip 80 forward and backwards along the longitudinal axis 17, the location of the tether 30 towards and away from the user's face and eyes may be adjusted.

As with the first embodiment of fastener 40, the clip 80 is described for use with the bill 16 of a baseball hat 14, but the clip 80 is suitable for use with other hats having a hard or stiff body.

The various embodiments of the fasteners 40 and clip 80 provide means for releasably fastening the tether 30 and/or its end piece 32 to the brim 16 of the hat 14. The shaft 44 and tube 48, shaft 44 and clutch 60, the shaft 44 and pin with end 72 or set screw 72 provide various means for releasably connecting the fastener 40 to the hat and for releasably connecting the tether to the bill of the hat at various locations.

The above description is given by way of example, and not limitation. Given the above disclosure, one skilled in the art could devise variations that are within the scope and spirit of the invention disclosed herein, including various ways of fastening the tether 30 to the bill 16 of the hat 14, and various ways of tightening the tether 30 to the temple arms 22 of eyeglasses 12. Additionally, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. An apparatus for connecting temple arms of a pair of eyeglasses to a bill of a hat where the bill has a thickness T, comprising:

first and second releasable fasteners each having one of a pointed shaft received in a bore or a clip configured to engage two surfaces of the bill of the hat;

first and second flexible tethers, each having a first end connected to a different one of the releasable fasteners and having a second end with an opening therein, and a slide lock movable along a length of the tether to vary the size of the opening, each tether being laterally flexible about an axis orthogonal to a length of the tether, each tether having a length of about 0.5 to about 4 inches;

wherein each tether comprises a flexible strip that is longer than it is wide with the longer part of the strip of folded back on itself to form a loop about the opening at the second end, and with opposing ends of the strip connected by an end piece to form the first end of the tether, each tether being of a material that can resiliently stretch at least around the opening at the second end;

wherein the first and second releasable fasteners each comprise a threaded male fastener having a pointed distal end opposite an enlarged head, the first and second fasteners each further having a mating female part with a recess configured to engage the male fastener, the male fastener passing through the first end of the tether.

2. An apparatus for connecting temple arms of a pair of eyeglasses to a bill of a hat where the bill has a thickness T, comprising:

first and second releasable fasteners each having one of a pointed shaft received in a bore or a clip configured to engage two surfaces of the bill of the hat;

first and second flexible tethers, each having a first end connected to a different one of the releasable fasteners and having a second end with an opening therein, and a slide lock movable along a length of the tether to vary the size of the opening, each tether being laterally flexible about an axis orthogonal to a length of the tether, each tether having a length of about 0.5 to about 4 inches;

wherein each tether comprises a flexible strip that is longer than it is wide with the longer part of the strip of folded back on itself to form a loop about the opening at the second end, and with opposing ends of the strip connected by an end piece to form the first end of the tether, each tether being of a material that can resiliently stretch at least around the opening at the second end;

wherein the first and second releasable fasteners each comprise a male fastener having a shaft with a pointed distal end opposite an enlarged head, the first and second fasteners each further having a clutch releasably engaging the shaft of the male fastener, the clutch further comprising a male projection having an end passing through a hole in the end fitting in a snap-fit connection.

3. An apparatus for connecting temple arms of a pair of eyeglasses to a bill of a hat where the bill has a thickness T, comprising:

first and second releasable fasteners each having one of a pointed shaft received in a bore or a clip configured to engage two surfaces of the bill of the hat;

first and second flexible tethers, each having a first end connected to a different one of the releasable fasteners and having a second end with an opening therein, and a slide lock movable along a length of the tether to vary the size of the opening, each tether being laterally flexible about an axis orthogonal to a length of the tether, each tether having a length of about 0.5 to about 4 inches;

wherein each tether comprises a flexible strip that is longer than it is wide with the longer part of the strip of folded back on itself to form a loop about the opening at the second end, and with opposing ends of the strip connected by an end piece to form the first end of the tether, each tether being of a material that can resiliently stretch at least around the opening at the second end;

wherein the first and second releasable fasteners each comprise a clip having first and second opposing side, each side having a length of about 0.5 to 1.5 inches and having a distal end spaced apart a distance less than a thickness T of the bill of the hat, each side having a proximal end joined to a base and spaced apart a first distance of about T at the base, the second side connected to the first end of the respective tether.

4. The apparatus of claim 2, further comprising a plurality of holes in a second side, with each hole threaded to receive a threaded fastener passing through a hole in the second end of the tether to connect the tether to the clip.

5. The apparatus of claim 1, wherein the first releasable fastener passes through a first side of the bill of the hat and the second fastener passes through a second, opposing side of that bill of the hat at a location opposite the first releasable fastener.

6. The apparatus of claim 2, wherein the first releasable fastener is connected to a first side of the bill of the hat and the second fastener is connected to a second, opposing side of that bill of the hat at a location opposite the first releasable fastener.

7. The apparatus of claim 4, wherein the first clip is connected to a first side of the bill of the hat and the second clip is connected to a second, opposing side of that bill of the hat at a location opposite the first releasable fastener.

8. The apparatus of claim 5, wherein the first temple arm passes through the opening in the first tether and the second temple arm passes through the opening in the second tether.

9. The apparatus of claim 6, wherein the first temple arm passes through the opening in the first tether and the second temple arm passes through the opening in the second tether.

10. The apparatus of claim 7, wherein the first temple arm passes through the opening in the first tether and the second temple arm passes through the opening in the second tether.

11. A kit for connecting temple arms of a pair of eyeglasses to a bill of a hat where the bill has a thickness T, comprising:

first and second releasable fasteners comprising one of a fastener including at least one component received in a bore or clip configured to engage two surfaces of the bill of the hat;

first and second tethers, each having a first end connected to a different one of the releasable fasteners and having a second end with an opening therein, and a slide lock movable along a length of the tether to vary the size of the opening, each tether being laterally flexible about an axis orthogonal to a length of the tether, each tether having a length of about 0.5 to about 4 inches, each tether being of a material that can resiliently stretch about 20% or more at least around the opening at the second end;

wherein each tether comprises an elongated flexible and elastic member with a rectangular cross-section is folded back on itself to form a loop about the opening at the second end, and with opposing ends of the member connected to the first end of the tether, and wherein the sliding lock is configured to easily slide along a length of the tether when the tether is stretched but not when the tether is not stretched;

wherein the first and second releasable fasteners each comprise a male fastener having a pointed head opposite an enlarged end and a length greater than T and less than about 3T, the first and second fasteners each further having a female part configured to releasably engage the male fastener, the first end of the tether configured to allow passage of the male fastener.

12. The kit of claim 11, wherein the first and second releasable fasteners each comprise a male fastener having a shaft with a pointed distal end opposite an enlarged head, the first and second fasteners each further having a clutch releasably engaging the shaft of the male fastener, the clutch further comprising a male projection having an end passing through a hole in the end fitting in a snap-fit connection.

13. The kit of claim 11, wherein the first and second releasable fasteners each comprise a clip having first and second opposing side, each side having a length of about 0.5 to 1.5 inches and having a distal end spaced apart a distance less than a thickness T of the bill of the hat, each side having a proximal end joined to a base and spaced apart a first distance of about T at the base, the second side connected to the first end of the respective tether.

14. The kit of claim 11, further comprising a plurality of holes in a second side, with each hole threaded to receive a threaded fastener passing through a hole in the second end of the tether to connect the tether to the clip.

* * * * *